US008417147B2

(12) United States Patent
Kamimura

(10) Patent No.: US 8,417,147 B2
(45) Date of Patent: Apr. 9, 2013

(54) IMAGE FORMING APPARATUS WITH TRANSLATION CAM MEMBER

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/366,277

(22) Filed: Feb. 4, 2012

(65) Prior Publication Data

US 2012/0269554 A1 Oct. 25, 2012

Related U.S. Application Data

(63) Continuation of application No. 13/108,387, filed on May 16, 2011, now Pat. No. 8,135,310, which is a continuation of application No. 12/840,875, filed on Jul. 21, 2010, now Pat. No. 7,970,314, which is a continuation of application No. 12/471,867, filed on May 26, 2009, now Pat. No. 7,787,805, which is a continuation of application No. 11/613,735, filed on Dec. 20, 2006, now Pat. No. 7,555,245.

(30) Foreign Application Priority Data

Dec. 27, 2005 (JP) ..... 2005-376114

(51) Int. Cl.
*G03G 15/01* (2006.01)

(52) U.S. Cl.
USPC ..... 399/112; 399/113; 399/228

(58) Field of Classification Search ..... 399/228, 399/111, 112, 113, 223, 298, 299; 347/115
See application file for complete search history.

(56) References Cited

U.S. PATENT DOCUMENTS

| | | | | |
|---|---|---|---|---|
| 6,546,218 | B2 | 4/2003 | Uchida | |
| 6,751,428 | B2 | 6/2004 | Okabe | |
| 6,795,671 | B2 | 9/2004 | Matsuoka | |
| 7,555,245 | B2 | 6/2009 | Kamimura | |
| 8,135,310 | B2 * | 3/2012 | Kamimura | 399/228 |
| 2003/0053819 | A1 | 3/2003 | Nomura et al. | |
| 2004/0265000 | A1 | 12/2004 | Okabe | |
| 2005/0069347 | A1 | 3/2005 | Okabe | |
| 2006/0034637 | A1 | 2/2006 | Kim et al. | |
| 2006/0153595 | A1 | 7/2006 | Yoon et al. | |
| 2007/0077093 | A1 | 4/2007 | Okabe et al. | |

FOREIGN PATENT DOCUMENTS

| | | |
|---|---|---|
| JP | 07-234552 | 9/1995 |
| JP | 07-295461 | 11/1995 |
| JP | 11-133730 | 5/1999 |
| JP | 2001-343809 | 12/2001 |

(Continued)

OTHER PUBLICATIONS

Machine translation of JP 2002-006716 A dated Oct. 1, 2010.

(Continued)

*Primary Examiner* — Sophia S Chen
(74) *Attorney, Agent, or Firm* — Banner & Witcoff, Ltd.

(57) ABSTRACT

An image forming apparatus includes a detaching and pressing mechanism for releasing developing rollers of developer cartridges mounted in a drum unit from photosensitive drums and pressing the developing rollers on the photosensitive drums. The detaching and pressing mechanism includes a pair of translation cam members, intermediate members provided on the translation cam members, cam holders for holding the translation cam members in such a manner as to be linearly movable in an anteroposterior direction, and a synchronous movement mechanism for allowing the pair of translation cam members to linearly move in synchronization.

12 Claims, 21 Drawing Sheets

FOREIGN PATENT DOCUMENTS

| | | |
|---|---|---|
| JP | 2002-006716 | 1/2002 |
| JP | 2003-084647 | 3/2003 |
| JP | 2004-020855 | 1/2004 |
| JP | 2004-037753 | 2/2004 |
| JP | 2005-037680 | 2/2005 |
| JP | 2005-107189 | 4/2005 |
| JP | 2005-181735 | 7/2005 |

OTHER PUBLICATIONS

Notice of Reasons for Rejection for Japanese Application No. 2005-376114 mailed May 18, 2010 and English translation thereof.

* cited by examiner

IMAGE FORMING APPARATUS WITH TRANSLATION CAM MEMBER

CROSS REFERENCE TO RELATED APPLICATIONS

This application is a continuation of U.S. patent application Ser. No. 13/108,387, filed on May 16, 2011, which is a continuation of U.S. patent application Ser. No. 12/840,875 filed on Jul. 21, 2010, now U.S. Pat. No. 7,970,314, issued Jun. 28, 2011, which is a continuation of Ser. No. 12/471,867 filed on May 26, 2009, now U.S. Pat. No. 7,787,805, issued Aug. 31, 2010, which is a continuation of U.S. patent application Ser. No. 11/613,735 filed on Dec. 20, 2006, now U.S. Pat. No. 7,555,245 issued Jun. 30, 2009, which claims priority to Japanese Patent Application No. 2005-376114 filed on Dec. 27, 2005, the disclosures of which are incorporated herein by reference.

BACKGROUND OF THE INVENTION

1. Field of the Invention

The present invention relates to an image forming apparatus including a laser printer.

2. Description of the Related Art

An image forming apparatus including photoreceptors arranged in parallel for their respective colors of yellow, magenta, cyan, and black, is generally known as a tandem image forming apparatus. The tandem image forming apparatus is provided with developing rollers for supplying the corresponding color toners to their respective photoreceptors. The color toners are supplied from the developing rollers to the photoreceptors, respectively, to form color toner images on surfaces of the photoreceptors substantially simultaneously. Then, the toner images of the respective colors on the surfaces of the photoreceptors are transferred directly to the paper so that the toner of the respective colors are superposed on the paper, thereby accomplishing the formation of a color image on the paper. Alternatively, the toner images of the respective colors are transferred to an intermediate transfer belt so that the toner of the respective colors are superposed on the intermediate transfer belt, first, and, then, the resultant color image is transferred to the paper, thereby accomplishing the formation of a color image on the paper.

A tandem image forming apparatus comprising cartridges having developing rollers, respectively, elastic members for biasing the cartridges in a direction of the developing rollers being pressed to photoreceptor belts, and detaching cams rotatably supported on rotating shafts extending in axial direction of the developing rollers is proposed as an example of such a tandem image forming apparatus (cf. Japanese Unexamined Patent Publication No, 2002-6716, for example). This image forming apparatus is structured so that when the detaching cams are brought into contact with supporting shafts of the developing rollers by the rotation of the detaching cams, the developing rollers are detached from the photoreceptor belts against biasing force of the elastic members. When the detaching cams are detached from the supporting shafts of the developing rollers, the developing rollers are pressed on the photoreceptor belts by the biasing force of the elastic members.

SUMMARY OF THE INVENTION

This proposed constitution has a disadvantage that since the elastic member and the detaching cam are provided for each of the cartridges, the components increase in number and the spaces for accommodating them increase, leading to increase in apparatus size.

Therefore, it is an object of the present invention to provide an image forming apparatus that can decrease the number of components.

An object of the present invention is to provide an image forming apparatus comprising: an apparatus body; a plurality of image carriers arranged in parallel with each other for their respective colors; a plurality of developing units provided correspondingly for the respective image carriers, each having a developing agent carrier for supplying a developing agent to the corresponding image carrier; a pair of translation cam members disposed opposite to each other across the plurality of developing units and adapted to be linearly movable in an arranging direction of the image carriers, for allowing the developing units to shift to contact positions where the developing agent carriers contact with the image carriers and detached positions where the developing agent carriers detach from the image carriers and also allowing the developing units to be pressed in a direction where the developer carriers contact with the image carriers in a state of the developing units being in the contact positions; and a synchronous movement mechanism for allowing the pair of translation cam members to linearly move in synchronization.

BRIEF DESCRIPTION OF THE DRAWINGS

FIG. 15 is a perspective view of the main body casing and the drum unit shown in FIG. 1, as viewed from above and right front, showing the main body casing which an exterior plate and a front cover are removed from and the drum unit is mounted in.

DETAILED DESCRIPTION OF THE PREFERRED EMBODIMENT

In the following, a preferred embodiment of the present invention is described with reference to the accompanying drawings.

1. Overall Structure of Color Laser Printer

Figure 1:
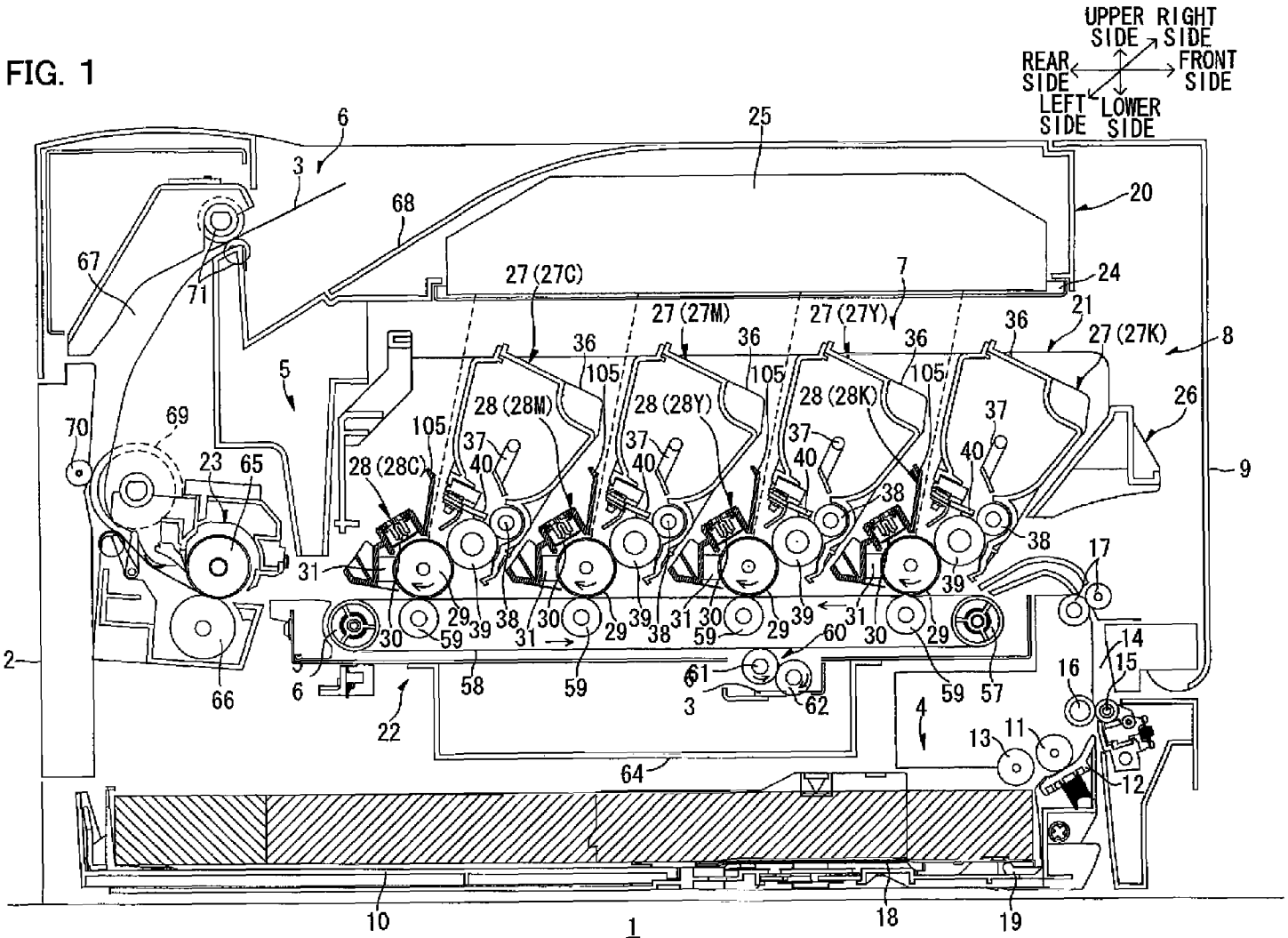
FIG. 1 is a sectional side view showing an embodiment of a color laser printer of an image forming apparatus of the present invention.

FIG. 1 is a sectional side view showing an embodiment of a color laser printer of an image forming apparatus of the present invention.

The color laser printer 1 is a horizontal tandem color laser printer wherein a plurality of drum subunits 28 described later are arranged in parallel in a horizontal direction. The color laser printer 1 comprises a paper feeding section 4 for feeding paper (sheet) 3 serving as recording media, an image forming section 5 for forming an image on the fed paper 3, and a paper ejection section 6 for ejecting the paper 3 formed with the image thereon which are in a main body casing 2 formed as an apparatus body.

Main Body Casing

The main body casing 2 is in the form of a box having a generally rectangular form, as viewed from side elevation. The main body casing 2 has in an interior thereof a drum accommodating room 7 formed to accommodate a drum unit 26 described later.

The main body casing 2 has a mounting port 8 formed on one lateral side thereof to communicate with the drum accommodating room 7. The main body casing 2 also has a front cover 9, formed on the lateral side thereof on which the mounting port 8 is formed, for opening and closing the mounting port 8. The mounting port 8 is opened by tilting the front cover 9 laterally with respect to the main body casing 2 and is closed by bringing the front cover 9 in the standing position along the one lateral side of the main body casing 2. The drum unit 26 can be mounted to and dismounted from the drum accommodating room 7 via the mounting port 8, with the mounting port 8 open.

In the following description, the side on which the front cover 9 is arranged (the right side in FIG. 1) is defined as the front side, and the side opposite thereto (the left side in FIG. 1) is defined as the rear side. The right side and the left side of the color laser printer are defined according to the orientation when the color laser printer 1 is viewed from the front side. Further, the front and rear and right and left and high and low of the drum unit 26 and the developer cartridge 27 are defined with the drum unit 6 and the developer cartridge 27 mounted in the main body casing 2, unless otherwise specified in the description.

(2) Paper Feeding Section

The paper feeding section 4 is provided at the bottom of the main body casing 2. The paper feeding section 4 includes a paper feed tray 10 for accommodating the paper 3, a separation roller 11 and a separation pad 12 provided above a front end portion of the paper feed tray 10 and disposed opposite to each other, a paper feed roller 13 provided behind the separation roller 11, and a paper feeding transport path 14 for passing of the paper 3.

The paper feeding transport path 14 is formed in a generally U-shape as viewed from side elevation. An upstream end portion of the paper feeding transport path 14 is adjacent to the separation roller 11 and a downstream end portion of the same 14 is adjacent to a transport belt 58 described later from the front side thereof.

A paper dust removing roller 15, a pinch roller 16, and a pair of registration rollers 17 arranged above those rollers 15, 16 are provided midway along the paper feeding transport path 14. The paper dust removing roller 15 and the pinch roller 16 are located above and in front of the separation roller 11 and are disposed opposite to each other.

The paper feed tray 10 is provided, in an interior thereof, with a paper pressing plate 18 on which the paper 3 are stacked. The paper pressing plate 18 is swingably supported at a rear end portion thereof, so that it can be swung between a paper stacked position where its front end portion is put in a relatively-low position along a bottom plate of the paper feed tray 10 and a paper feeding position where its front end portion is put in a relatively-high position and titled.

A lever 19 for lifting up the front end portion of the paper pressing plate 18 is provided on the lower side of a front end portion of the paper feed tray 10. The lever 19 is supported on the lower side of the front end portion of the paper pressing plate 18 so that it can be swingable in a vertical direction.

By the swinging motion of the lever 19, the front end portion of the paper pressing plate 18 is lifted up by the lever 19 and positioned in the paper feeding position.

When the paper pressing plate 18 is put in the paper feeding position, a top paper 3 of the stacked paper on the paper pressing plate 18 is pressed against the paper feed roller 13 and fed toward a position between the separation roller 11 and the separation pad 12 by rotation of the paper feed roller 13.

When the paper feed tray 10 is removed from the main body casing 2, the paper pressing plate 18 is put in the paper stacked position. When the paper pressing plate 18 is put in the paper stacked position, the paper 3 can be stacked on the paper pressing plate 18.

The paper 3 fed are sandwiched between the separation roller 11 and the separation pad 12 by the rotation of the separation roller 11 and separated one by one therebetween. Then, the paper 3 fed passes through between the paper dust removing roller 15 and the pinch roller 16, between which the paper dust is removed from the paper. Thereafter, the paper 3 is transported toward the registration rollers 17 along the paper feeding transport path 14.

The registration rollers 17 work to transport the paper 3 after registration to a transport belt 58.

(3) Image Forming Section

The image forming section 5 includes a scanner section 20, a process portion 21, and a transfer section 22, and a fixation section 23.

(3-1) Scanner Section

The scanner section 20 is arranged at an upper portion of the main body casing 2. The scanner section 20 includes a supporting plate 24 extending vertically and laterally, and a scanner unit 25 fixed on the upper surface of the supporting plate 24. The scanner unit 25 has optical members such as four light sources, polygonal mirrors, f θ lenses, reflectors, and surface drop correcting lenses in an interior thereof. Laser beams emitted from the respective laser sources based on the image data are polarized and scanned by the polygonal mirrors, first, and then after they pass through the f θ lenses and the surface drop correcting lenses, the laser beams are reflected by the reflectors, to irradiate respective surfaces of photosensitive drums 29 for respective colors with the laser beams by high-speed scanning (3-2) Process Section The process section 21 is arranged below the scanner section 20 and above the paper feeding section 4. The process section 21 includes a drum unit 26 as a single tandem process unit, and developer cartridges 27 as four developer units for respective colors.

(3-2-1) Drum Unit

The drum unit 26 includes four drum subunits 28 for respective colors. Specifically, the drum subunits 28 comprise four drum subunits of a black drum subunit 28K, a yellow drum subunit 28Y, a magenta drum subunit 28M, and a cyan drum subunit 28C.

These drum subunits 28 are arranged in parallel and spaced apart from each other in a front and rear direction. To be more specific, the black drum subunit 28K, the yellow drum subunit 28Y, the magenta drum subunit 28M, and the cyan drum subunit 28C are arranged in this order from the front to the rear.

Each drum subunit 28 comprises a pair of side frames 104, and a center frame 105 extended therebetween, as described later (see FIG. 4).

Figure 2:
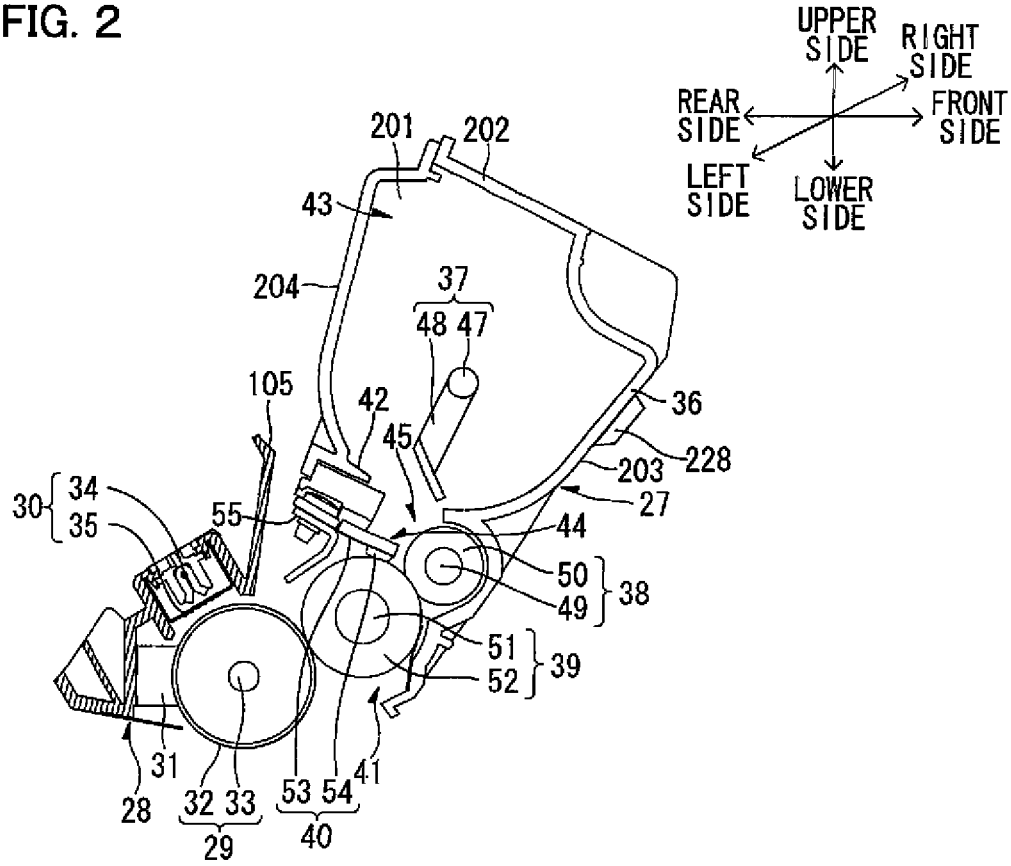
FIG. 2 is a sectional side view of a developer cartridge and a drum subunit shown in FIG. 1.

FIG. 2 is a side sectional view of the developer cartridge 27 and the drum subunit 28. In FIGS. 1 and 2, a handle 214 described later is not illustrated.

As shown in FIG. 2, each drum subunit 28 holds a photosensitive drum 29 serving as an image carrier, a scorotron charger 30, and a cleaning brush 31.

The photosensitive drum 29 is arranged along a right side and left side direction and shaped in a cylindrical form. The photosensitive drum 29 comprises a drum body 32 whose outermost surface layer is formed by a positive-charging photosensitive layer formed of polycarbonate, and a drum shaft 33 arranged along an axial direction of the drum body 32. The drum body 32 is rotatable relative to the drum shaft 33. Both axial end portions of the drum shaft 33 are inserted through the pair of side frames 104 (see FIG. 4) and supported by side plates 103 described later (see FIG. 4) in a non-rotatable manner. The photosensitive drum 29 is rotationally driven by a driving force input from a motor (not shown) provided in the main body casing 2.

The scorotron charger 30 is supported by the center frame 105 at a position on the obliquely rearward and upward side of the photosensitive drum 29 and is disposed opposite to and spaced apart from the photosensitive drum 29. The scorotron charger 30 includes a discharge wire 34 disposed opposite to and spaced apart from the photosensitive drum 29, and a grid 35 disposed between the discharge wire 34 and the photosensitive drum 29. When an image is formed, a high voltage is applied to the discharge wire 34 so that corona discharge can be generated from the discharge wire 34 and also a voltage is applied to the grid 35 so that an amount of electric charge applied to the photosensitive drum 29 is controlled, to allow a surface of the photosensitive drum 29 to be uniformly charged positively.

The cleaning brush 31 is held by the center frame 105 at a location on the rear side of the photosensitive drum 29 to oppose to and contact with the photosensitive drum 29. When the image is formed, a cleaning bias is applied to the cleaning brush 31.

(3-2-2) Developer Cartridge

The developer cartridges 27 are respectively detachably mounted to the drum subunits 28 for respective colors, as shown in FIG. 1. That is, the developer cartridges 27 comprise four cartridges of a black developer cartridge 27K detachably mounted to the black drum subunit 28K, a yellow developer cartridge 27Y detachably mounted to the yellow drum subunit 28Y, a magenta developer cartridge 27M detachably mounted to the magenta drum subunit 28M, and a cyan developer cartridge 27C detachably mounted to the cyan drum subunit 28C.

Each developer cartridge 27 includes a developer frame 36, as shown in FIG. 2. Each developer cartridge 27 also includes, in an interior of the developer frame 36, an agitator 37, a feed roller 38, a developing roller 39 serving as a developing agent carrier, and a layer-thickness regulation blade 40.

The developer frame 36 is configured in a box form having an opening 41 opened at the lower end portion. The interior of the developer frame 36 is partitioned into a toner accommodating chamber 43 and a developing chamber 44 by a partition wall 42. A communication port 45 is formed in the partition wall 42, via which the toner accommodating chamber 43 and the developing chamber 44 communicate with each other.

Respective color toners are accommodated in the corresponding toner accommodating chambers 43. To be more specific, black toner, yellow toner, magenta toner, and cyan toner are accommodated in the black developer cartridge 27K, the yellow developer cartridge 27Y, the magenta developer cartridge 27M, and the cyan developer cartridge 27C, respectively.

Polymerized toner comprising one positively-charged nonmagnetic component is used for the color toners. The polymerized toner is generally spherical in shape. The polymerized toner comprises primarily binder resin produced by allowing styrene monomer such as styrene, and acrylic monomer such as acrylic acid, alkyl (C1-C4) acrylate and alkyl (C1-C4) methacrylate to be copolymerized by a known polymerization method such as suspension polymerization and the like. Then, colorants for the respective colors, an electric charge controlling agent, wax, and the like are mixed in the binder resin to form toner main particles. Further, in order to improve the fluidity of the toners, additive material is also added to the toner.

As to the colorant, black colorant, yellow colorant, magenta colorant, and cyan colorant are mixed in the above-said corresponding color toners, respectively. As to the electric charge controlling agent, an electric charge controlling resin produced by copolymerizing an ionic monomer having an ionic functional group such as ammonium salt with a monomer copolymerizable with an ionic monomer, such as a styrene monomer and an acrylic monomer, is mixed in the toner. As to the additive material, an inorganic powder including, for example, a powder of metal oxides, such as silica, aluminum oxide, titanium oxide, strontium titanate, cerium oxide and magnesium oxide, a powder of carbide and a powder of metal salts are mixed in the toner.

The agitator 37 is provided in the toner accommodating chamber 43. The agitator 37 comprises an agitator rotating shaft 47 rotatably supported on both side walls 201, described later, of the developing agent frame 36, and an agitating member 48 extending along the axial direction of the agitator rotating shaft 47 and projecting radially outwardly from the rotating shaft. When the image is formed, the agitating member 48 is revolved in the toner accommodating chamber 43 by a driving force transmitted from a motor (not shown) provided in the main body casing 2 to the agitator rotating shaft 47.

The feed roller 38 is disposed in the developing chamber 44 at a location below the communication port 45. The feed roller 38 includes a feed roller shaft 49 formed of metal rotatably supported on the both side walls 201 of the developing frame 36, and a sponge roller 50 formed of conductive sponge for covering the outside of the feed roller shaft 49. When the image is formed, the feed roller 38 is rotated by a driving force from a motor (not shown) in the main body casing 2.

The developing roller 39 is disposed in the developing chamber 44 at a location obliquely rearward and downward with respect to the feed roller 38. The developing roller 39 includes a developing roller shaft 51 formed of metal rotatably supported on the developing frame 36, and a rubber roller 52 formed of conductive rubber for covering the outside of the developing roller shaft 51.

The rubber roller 52 has a two-layer structure comprising a rubber roller layer formed of conductive urethane rubber, silicone rubber, or EPDM rubber including carbon fine particles and the like, and a coating layer coating the surface of the rubber roller layer comprising primarily urethane rubber, urethane resin, and polyimide resin.

The developing roller 39 is disposed with respect to the feed roller 38 so that the rubber roller 52 of the developing roller 39 and the sponge roller 50 of the feed roller 38 are put in press contact with each other. Further, the developing roller 39 is disposed to be exposed downwards from the opening 41 of the developing chamber 44.

When the image is formed, the developing roller 39 is rotated by a driving force from a motor (not shown) in the main body casing 2 transmitted to the developing roller 39, and a developing bias is applied to the developing roller 39.

The layer-thickness regulation blade 40 is arranged in the developing chamber 44 so that it can be put in press contact with the developing roller 39 from above. The layer-thickness regulation blade 40 comprises a blade 53 formed of a metal spring member and a pressing portion 54 of generally semi-circular form in section which is formed of insulative silicon rubber and provided at a free end portion of the blade 53.

A base end portion of the blade 53 is fixed to the partition wall 42 via a fixing member 55, and the pressing portion 54 at the free end portion of the blade 53 is press-contacted with the rubber roller 52 of the developing roller 39 from above by an elastic force of the blade 53.

(3-2-3) Developing Operation in Process Section

In the each developer cartridge 27, the color toner accommodated in the toner accommodating chamber 43 drop under its own weight to the communication port 43 and is discharged from the communication port 45 to the developing chamber 44 while being agitated by the agitator 37.

The toner discharged from the communication port 45 into the developing chamber 44 is supplied onto the feed roller 38. Then, the toner supplied to the feed roller 38 is supplied onto the developing roller 39 by the rotation of the feed roller 38, during which the toner is positively charged by friction between the feed roller 38 and the developing roller 39 to which the developing bias is applied.

Following the rotation of the developing roller 39, the toner supplied onto the developing roller 39 enters an area between the pressing portion 54 of the layer-thickness regulation blade 40 and the rubber roller 52 of the developing roller 39 and is carried on the rubber roller 52 as a thin layer having a uniform thickness.

On the other hand, in the drum subunit 28 corresponding to the developing cartridge 27, electric corona discharge is generate by the scorotron charger 30, so that a surface of the photosensitive drum 28 is positively charged uniformly.

Following the rotation of the photosensitive drum 29, the surface of the photosensitive drum 29 is positively charged uniformly by the scorotron charger 30 and then is exposed to light from the scanner section 20 by high-speed scanning using laser beam, to form on the surface of the photosensitive drum 29 an electrostatic latent image corresponding to an image to be formed on the paper 3.

When the photosensitive drum 29 is rotated further, the toner carried on the surface of the developing roller 39 and positively charged is supplied by the rotation of the developing roller 39 to the electrostatic latent image formed on the surface of the photosensitive drum 29 or exposed portions which is exposed by the laser beam and drops in electric potential in the uniformly-positively-charged surface of the photosensitive drum 29. As a result, the electrostatic latent image on the surface of the photosensitive drum 29 is converted to a visible image by development process and the visible toner image for each corresponding color created by the reversal development process is carried on the surface of the photosensitive drum 29.

The remaining toner left on photosensitive drum 29 after transfer is collected by the developing roller 39. Further, the paper dust from the paper 3 attached to the photosensitive drum 29 after transfer is collected by the cleaning brush 31.

(3-3) Transfer Section

As shown in FIG. 1, the transfer section 22 is arranged in the main body casing 2 at a location above the paper feed section 4 and under the process section 21, along the front and rear direction. The transfer section 22 comprises a driving roller 56, a driven roller 57, a carrying belt 58, transfer rollers 59, and a cleaning section 60.

The driving roller 56 and the driven roller 57 are spaced apart from and disposed opposite to each other in the front and rear direction. The driving roller 56 is disposed behind the cyan drum subunit 28C, and the driven roller 57 is disposed in front of the black drum subunit 28K.

The carrying belt 58 is an endless belt, which is made by a resin film formed of e.g. conductive polycarbonate or polyimide in which conductive particles such as carbon particles are dispersed. The carrying belt 58 is wound around the driving roller 56 and the driven roller 57.

When the image is formed, a driving force from a motor (not shown) arranged in the main body casing 2 is transmitted to the driving roller 56 to rotate the driving roller 56. Then, the carrying belt 58 is moved around between the driving roller 56 and the driven roller 57 in an opposite direction to a rotation direction of the photosensitive drum 29 the at transfer positions where the carrying belt 58 opposes to and contacts with the photosensitive drums 29 of the drum subunits 28. Then, the driven roller 57 is driven.

The respective transfer rollers 59 are arranged in an interior space surrounded by the carrying belt 58 which is extended between the driving roller 56 and the driven roller 57 and disposed opposite to the photosensitive drums 29 across the carrying belt 58. Each transfer roller 59 comprises a metal roller shaft covered by a rubber roller formed of conductive rubber. The respective transfer rollers 59 are arranged at the transfer positions where they oppose to and contact with the carrying belt 58 so that they can be rotationally driven in the same direction as the moving direction of the carrying belt 58. When the image is formed, the transfer bias from a high-voltage board, not shown, arranged in the main body casing 2 is applied to the transfer rollers 59.

The cleaning section 60 is arranged below the carrying belt 58 extended between the driving roller 56 and the driven roller 57. The cleaning section 60 includes a primary cleaning roller 61, a secondary cleaning roller 62, a scraping blade 63, and a toner storing portion 64.

The primary cleaning roller 61 is disposed to contact with a lower portion of the carrying belt 58 opposite to an upper portion of the carrying belt 58 with which the photosensitive drums 29 and the transfer rollers 59 contact. The primary cleaning roller 61 is arranged at the contact position where it contacts with the carrying belt 58 so that it can be rotationally driven in the same direction as the moving direction of the carrying belt 58. When the image is formed, a primary cleaning bias is applied to the primary cleaning roller 61.

The secondary cleaning roller 62 is disposed to contact with the primary cleaning roller 61 from below. The secondary cleaning roller 62 is arranged at the contact position where it contacts with the primary cleaning roller 61 so that it can be rotationally driven in the opposite direction to the rotation direction of the primary cleaning roller 61. When the image is formed, a secondary cleaning bias is applied to the secondary cleaning roller 62.

The scraping blade 63 is arranged to contact with the secondary cleaning roller 62 from below.

The toner storing portion 64 is provided under the primary cleaning roller 61 and the secondary cleaning roller 62, to store the toners dropped from the secondary cleaning roller 62.

The paper 3 fed from the paper feed section 4 is carried by the carrying belt 58 which is moved around by the drive of the driving roller 56 and the driven motion of the driven roller 57, and passes through the transfer positions corresponding to the respective drum subunits 28 from front to rear in order. During this transport of the paper 3, the respective color toner images carried on the photosensitive drums 29 of the drum subunits 28 are sequentially transferred to the paper 3 to form a color image on the paper 3.

For example, a black toner image carried on the surface of the photosensitive drum 29 of the black drum subunit 28K is transferred to the paper 3, first. Then, a yellow toner image carried on the surface of the photosensitive drum 29 of the yellow drum subunit 28Y is superposed on and transferred to the paper 3 on which the black toner image already transferred. In the subsequent transfer processes, the same operation is performed, whereby a magenta toner image carried on the surface of the photosensitive drum 29 of the magenta drum subunit 28M and a cyan toner image carried on the surface of the photosensitive drum 29 of the cyan drum subunit 28C are sequentially superposed on and transferred to the paper 3. As a result of this, a color image is formed on the paper 3.

On the other hand, during the above-mentioned transfer operation, the toner attached to the surface of the carrying belt 58 is transferred from the surface of the carrying belt 58 to the primary cleaning roller 61 by the primary cleaning bias in the cleaning section 60. Further, the toner is transferred from the first cleaning roller 61 to the secondary cleaning roller 62 by the secondary cleaning bias. Thereafter, the toner transferred to the secondary cleaning roller 62 is scraped by the scraping blade 63. The scraped toner drops from the secondary cleaning roller 62 and is stored in the toner storing portion 64.

(3-4) Fixation Section

The fixation section 23 is arranged behind the cyan drum subunit 28C in the main body casing 2 to oppose in the front and rear direction to the transfer positions where the photosensitive drums 29 and the carrying belt 58 contact with each other. The fixation section 23 comprises a heating roller 65 and a pressing roller 66.

The heating roller 65 comprises a metal pipe formed with a release layer thereon, and a halogen lamp is housed in the metal pipe along an axial direction thereof. The heating roller 65 is heated to a fixation temperature by the halogen lamp.

The pressing roller 66 is disposed opposite to the heating roller 65 below the heating roller 65. The pressing roller 66 presses the heating roller 65 from below.

The paper 3 on which the color image transferred is transported to the fixation section 23 and the color image is thermally fixated on the paper 3 during the time when the paper 3 passes through between the heating roller 65 and the pressing roller 66. As a result of this, the formation of the image on the paper 3 is completed.

(4) Paper Ejection Section

In the paper ejection section 6, an upstream end portion of a paper-ejecting transport path 67, on a lower side thereof, is adjacent to the fixation section 23. A downstream end portion of the paper-ejecting transport path 67, on an upper side thereof, is adjacent to a paper ejection tray 68. The paper-ejecting transport path 67 is formed in a generally U-shape, as viewed from the side, so that the paper 3 is fed rearwards, turned around, and ejected forwards.

A transporting roller 69 and a pinch roller 70 opposing to each other are provided midway along the paper-ejecting transport path 67. A pair of paper ejection rollers 71 are provided at the downstream end portion of the paper-ejecting transport path 67.

The paper ejection section 6 is provided with the paper ejection tray 68. The paper ejection tray 68 is formed by concaving an upper surface of the main body casing 2 gradually from front to rear so that sheets of paper 3 ejected can be stacked on it.

The paper 3 transported from the fixation section 23 is transported along the paper-ejecting transport path 67 by the transporting roller 69 and the pinch roller 70 and then is ejected onto the paper ejection tray 68 by the paper ejection rollers 71.

2. Drum Unit

Figure 3:
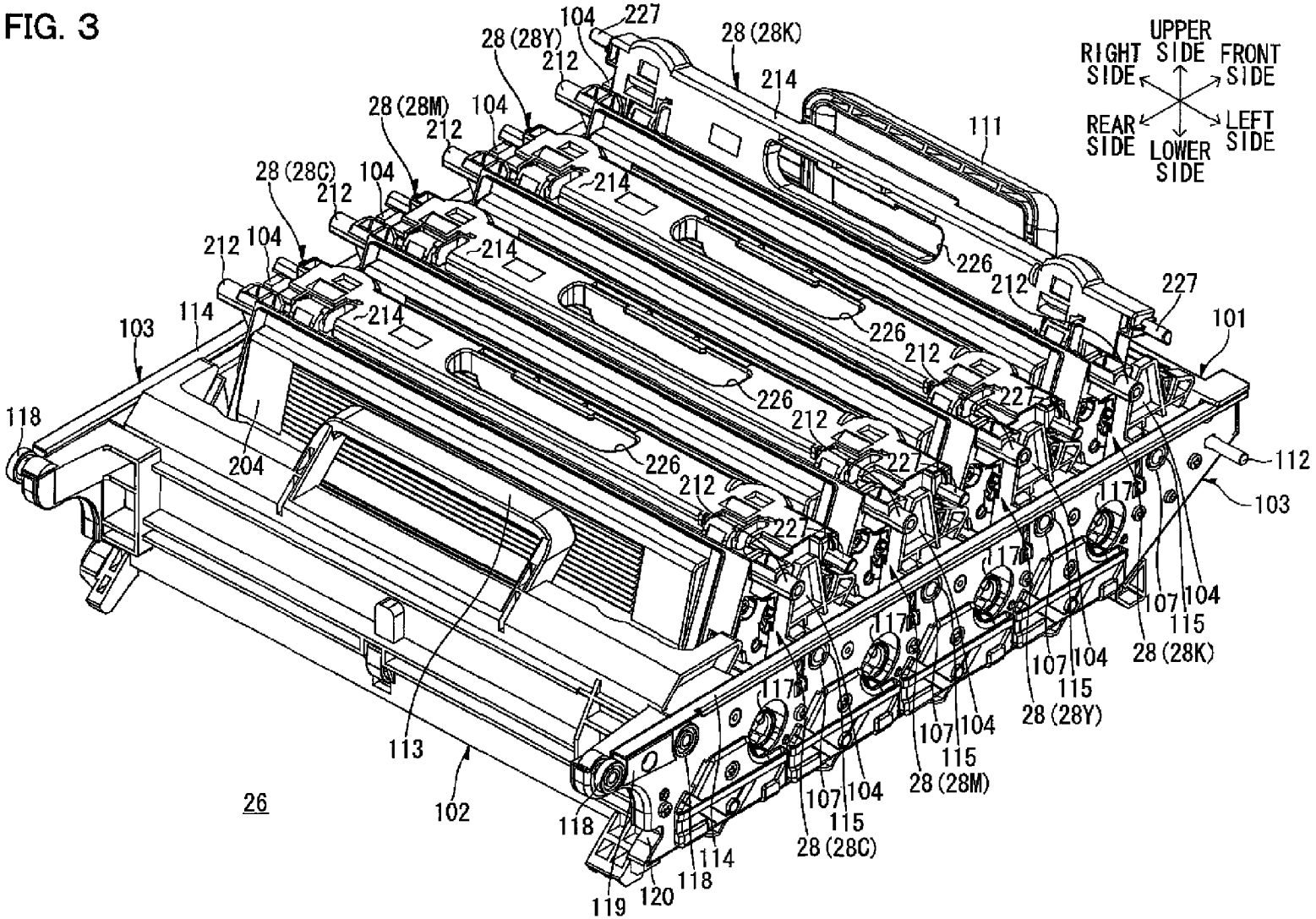
FIG. 3 is a perspective view of a drum unit shown in FIG. 1 (which is in the state that four developer cartridges are mounted) as viewed from above and left rear.

FIG. 3 is a perspective view of the drum unit 26 (which is in the state that the four developer cartridges 27 are mounted therein) as viewed from above and left rear. FIG. 4 is a perspective view of the drum unit 26 (which is in the state that one developer cartridge 27 is in the course of being mounted therein and the other developer cartridges 27 are already removed therefrom) as viewed from above and left front. FIG. 5 is a left side view of the drum unit 26.

The drum unit 26 comprises the four drum subunits 28 for the corresponding colors, a front beam 101 and a rear beam 102 which are provided on both front and rear sides of the four drum subunits 28 arranged in parallel along the front and rear direction, and a pair of side plates 103 sandwiching the front beam 101, four drum subunits 28 and rear beam 102 therebetween from both widthwise sides (from right side and left side).

The drum unit 26 is formed by combining together the four drum subunits 28, the front beam 101, the rear beam 102, and the pair of side plates 103. The drum unit 26 is slidably mounted to and dismounted from the drum accommodating room 7 (see FIG. 1) in the main body casing 2.

Drum Subunit

Figure 4:
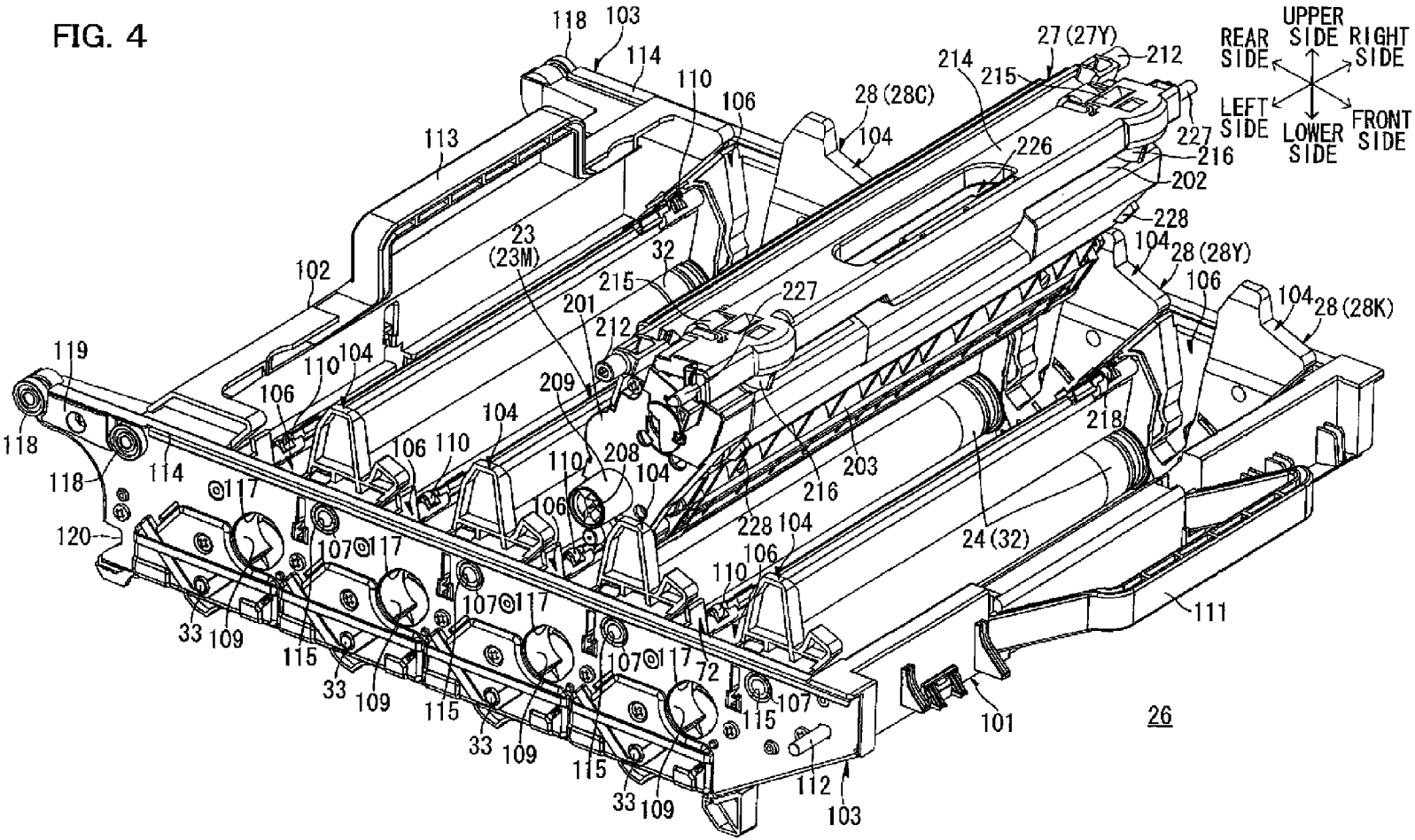
FIG. 4 is a perspective view of the drum unit shown in FIG. 1 (which is in the state that one developer cartridge is in the course of being mounted in or dismounted from the drum unit and the other developer cartridges are already removed therefrom) as viewed from above and left front.
Figure 5:
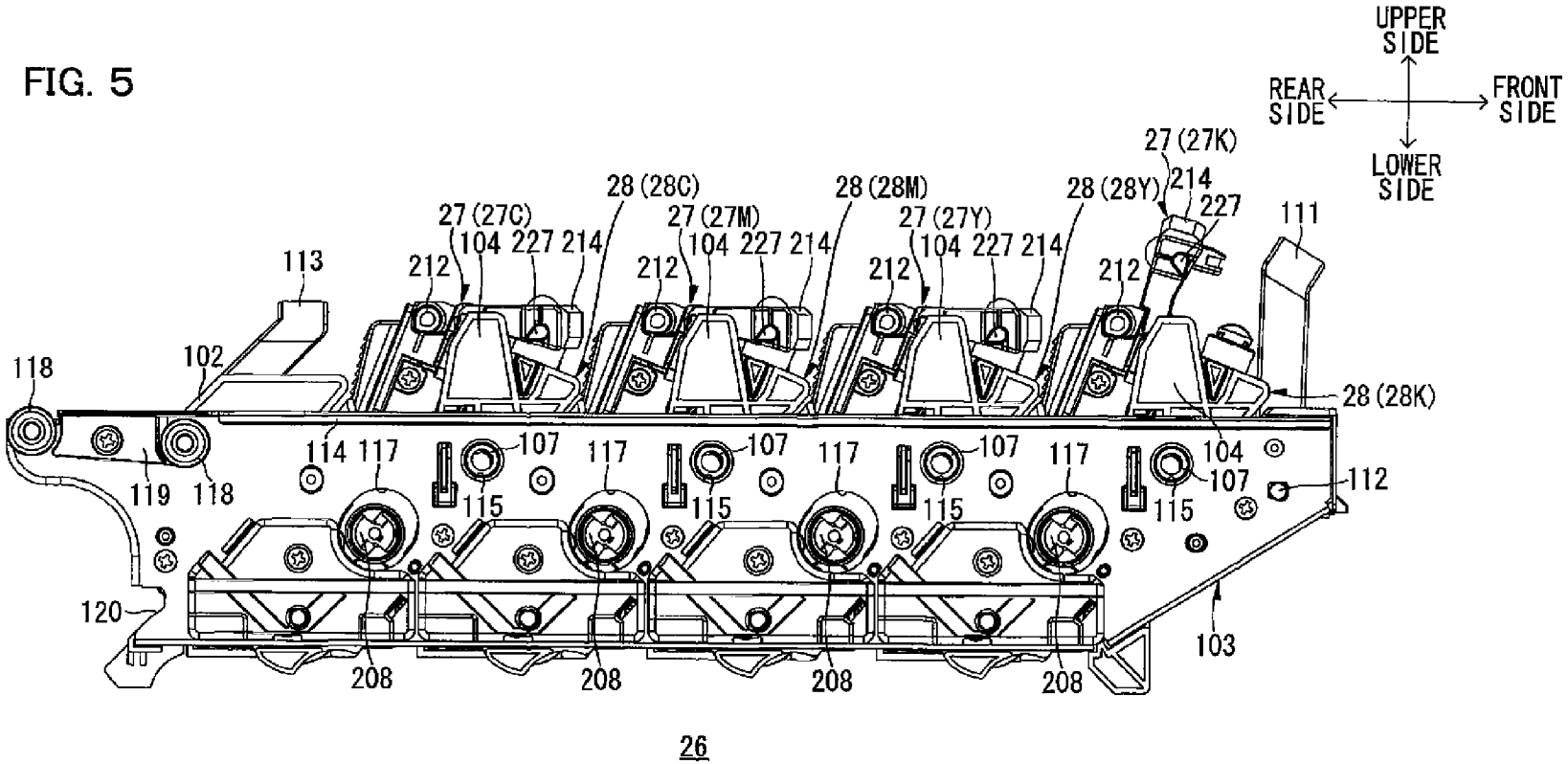
FIG. 5 is a left-side view of the drum unit shown in FIG. 1.

As shown in FIG. 4, the drum subunit 28 comprises a pair of side frames 104 spaced apart from and opposite to each other in the widthwise direction, and a center frame 105 (see FIG. 2) extended widthwise between the both side frames 104.

The side frames 104 are formed in a flat-plate form using resin material. The drum shafts 33 of the photosensitive drums 29 are inserted through the respective side frames 104.

Guide grooves 106 are formed on the respective side frames 104 for guiding mounting and dismounting of the developer cartridges 27 to and from the drum subunits 28. The guide grooves 106 are formed to extend from upper edges of the rear side of the side frames 104 to close proximity of lower ends of the front side thereof along a generally vertical direction. The guide grooves 106 are formed so that their lower end portions (deepest portions) correspond in position to the developing roller shafts 51 at the locations at which the developing rollers 39 are brought into contact with the photosensitive drums 29. Collar members 205 described later are slidably received in the guide grooves 106.

Each side frame 104 has bosses 107 formed therein. The bosses 107 are each formed in a cylindrical form projecting widthwise outwardly from the side frame 104. The bosses 107 are arranged so that when the developing agent cartridges 27 are mounted in the drum subunits 28, windows 206, described later, of the developer cartridges 27 oppose to the bosses 107, respectively, in the widthwise direction.

The left-side side frame 104 has coupling inner-insertion holes 109 formed therein. The coupling inner-insertion holes 109 are arranged to be opposed by coupling passive gears 208, described later, of the developing agent cartridges 27, respectively, in the widthwise direction. These coupling inner-insertion holes 109 are formed as round holes extending through the left-side side frame 104 in the thickness direction.

The center frames 105 are formed using resin material. Each center frame 105 is provided, at the both widthwise end portions of an upper end portion thereof with supporting rollers 110 serving as supporting portions for supporting the developer cartridges 27. The supporting rollers 110 are rotatably supported by rotation shafts, not shown, extending in the widthwise direction along the upper end portion of the respective center frames 105.

Front Beam

The front beam 101 is molded in one piece, using the resin material. The front beam 101 is disposed in front of the four drum subunits 28 arranged in parallel along the front and rear direction and is bridged between the pair of side plates 103.

The front beam 101 is provided with a near-side grip 111 attached to a widthwise center of the front beam 101, and a support shaft 112 for rotatably supporting the near-side grip 111.

The near-side grip 111 is in a generally U-shape. The near-side grip 111 is pivotally supported on the support shaft 112 at free end portions thereof at the widthwise center so that it can be swung between its accommodated position where it stands along the front beam 101 (see FIG. 3) and its operating position where it is tilted forward of the front beam 101 (see FIG. 4).

The support shaft 112 is arranged to extend through the front beam 101 along the widthwise direction and is supported on the front beam 101. Both widthwise end portions of the support shaft 112 project widthwise outwards from the front beam 101 and further extend through the side plate 103, and then project widthwise outwards from the side plates 103.

Rear Beam

The rear beam 102 is molded in one piece, using the resin material. The rear beam 102 is disposed behind the four drum subunits 28 arranged in parallel along the front and rear direction and is bridged between the pair of side plates 103.

The rear beam 102 is in a generally flat-bottomed U-shape, opening at the rear, as viewed from top, as shown in FIG. 3. The rear beam 102 is integrally provided with a far-side grip 113 attached to a widthwise center of the rear beam 102. The far-side grip 113 is in a generally U-shape as viewed from rear. The far-side grip 113 is connected to the rear beam 102 at free end portions thereof and is tilted forwards and upwards to project obliquely upwards from the rear beam 102.

(4) Side Plates

The side plates 103 are formed from material, such as a metal or fiber-reinforced resin, of higher rigidity than the resin material for the drum subunits 23, front beam 101, and rear beam 102. Preferably, the side plates 103 are formed of steel plate.

The side plates 103 are formed in a generally anteroposteriorly elongated rectangular plate form as viewed from side elevation. The side plates 103 are formed in such a relation to the front beam 101, the four drum subunits 28 and the rear beam 102 which are arranged in parallel in the front and rear direction that their front end portions oppose to the front beam 101 and their rear end portions oppose to the rear beam 102. The side plates 103 are fixed to the front beam 101 at the front end portions thereof and are fixed to the rear beam 102 at the rear end portions thereof.

The side plates 103 have at upper end portions thereof, flanged portions 114 extending widthwise outwards along a front and rear direction by being bent in a widthwise outward direction to be formed in an L-shape. The flanged portions 114 extend linearly along the front and rear direction (horizontal direction).

The respective side plates 103 have, at rear end portions thereof, rearward extending portions formed by extending upper end portions thereof rearwards. The rearward extending portions are formed in a generally L-shape, as viewed from side elevation, and are provided with two rotatable rolling members 118. The two rolling members 118 are spaced apart from each other in the front and rear direction, with a spacer 119 sandwiched therebetween. The rolling member 118 on the front side is located below the flanged portion 114, and the rolling member 118 on the rear side is located behind a rear end portion of the flanged portion 114.

Further, each side plate 103 has, at a rear end portion thereof, a cut away portion 120 cut away in a generally U-shape, as viewed from side elevation, from a rear edge thereof. When the drum unit 26 is mounted in the main body casing 2, a positioning shaft (not shown) disposed in the main body casing 2 is fitted in the cut away portion 120 and thereby the drum unit 26 is positioned with respect to the main body casing 2.

Each side plate 103 has, at an upper end portion thereof, four light transmission holes 115 for receiving the bosses 107 of each drum subunit 28. The four light transmission holes 115 in the upper end portion of the side plate 103 are spaced apart from each other along the front and rear direction. The light transmission holes 115 are formed as round holes extending through in the thickness direction at locations opposing to the bosses 107 of the drum subunits 28 with respect to the widthwise direction. The bosses 107 of the drum subunits 28 are fitted in the respective light transmission holes 115 so that they are exposed outwardly in the widthwise direction. This restricts the drum subunits 28 from pivoting about their respective drum shafts 33 with respect to the side plates 103.

Each side plate 103 has shaft holes 116 formed at a lower end portion thereof through which an axial end portion of the drum shafts 33 is inserted.

The left-side side frame 103 has coupling outer-insertion holes 117 formed therein. The coupling outer-insertion holes 117 are arranged to be opposed by the coupling passive gears 208 of the developer cartridges 27, respectively, in the widthwise direction. Four coupling outer-insertion holes 117 are formed at vertical center of the side plate 103 and spaced apart from each other along the front and rear direction. These coupling outer-insertion holes 117 are formed as round holes extending through in the thickness direction at locations where they oppose to the coupling inner-insertion holes 109 of the drum subunits 28 with respect to the widthwise direction.

Developer Cartridge

Figure 6:
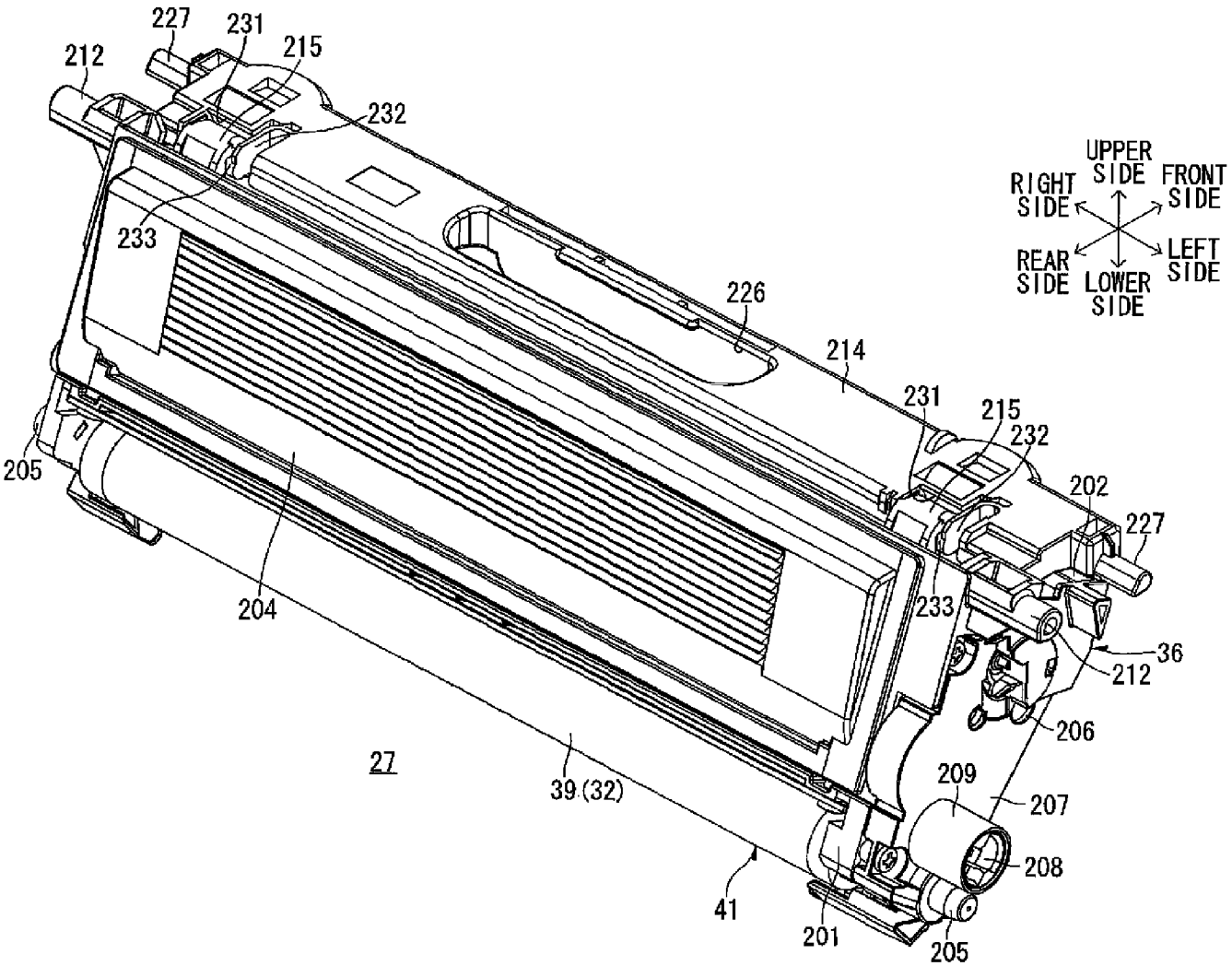
FIG. 6 is a perspective view of the developer cartridge shown in FIG. 1, as viewed from above and left rear, showing a handle which is in the tilted position.
Figure 7:
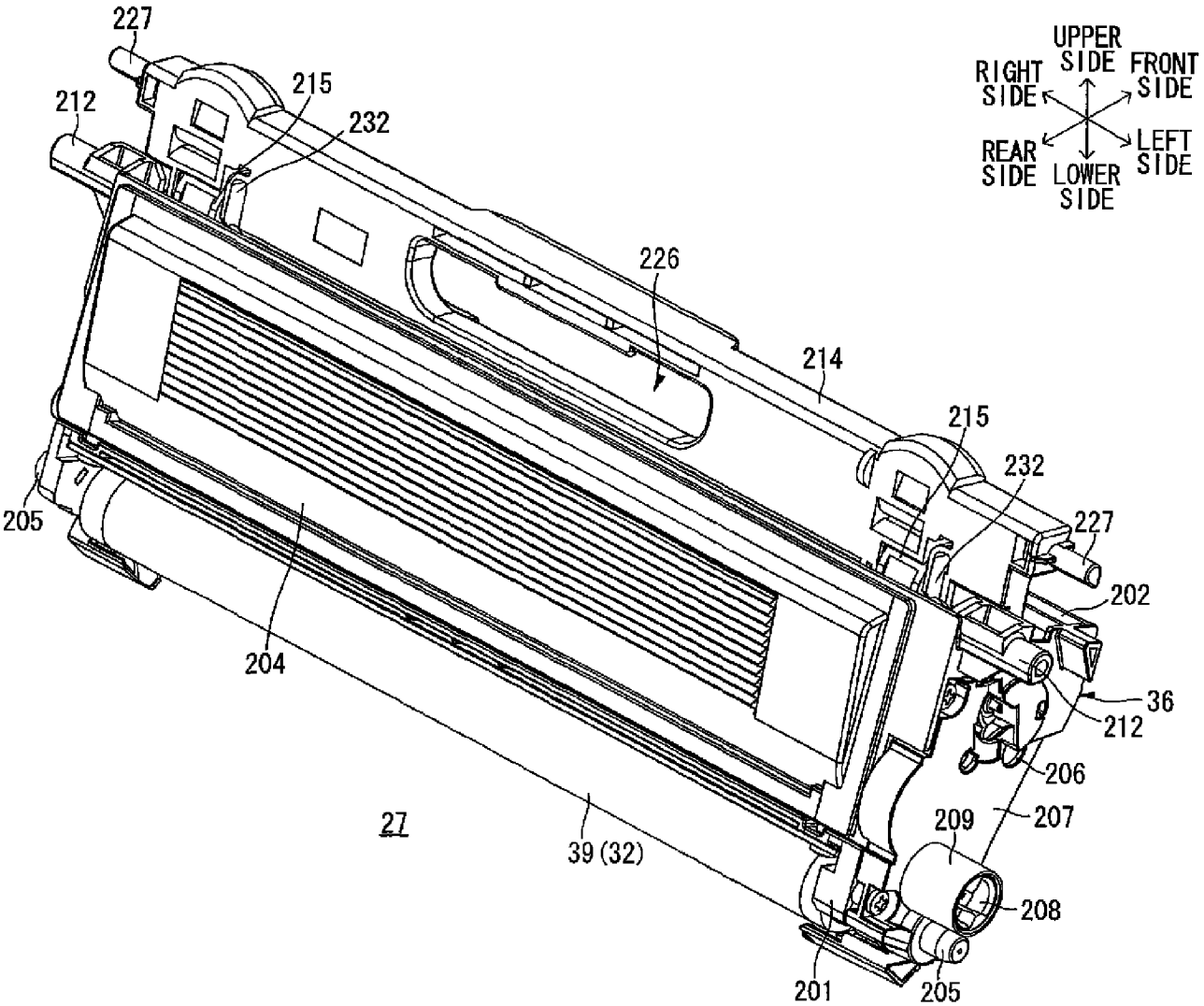
FIG. 7 is a perspective view of the developer cartridge shown in FIG. 1, as viewed from left rear, showing the handle which is in the standing position.
Figure 8:
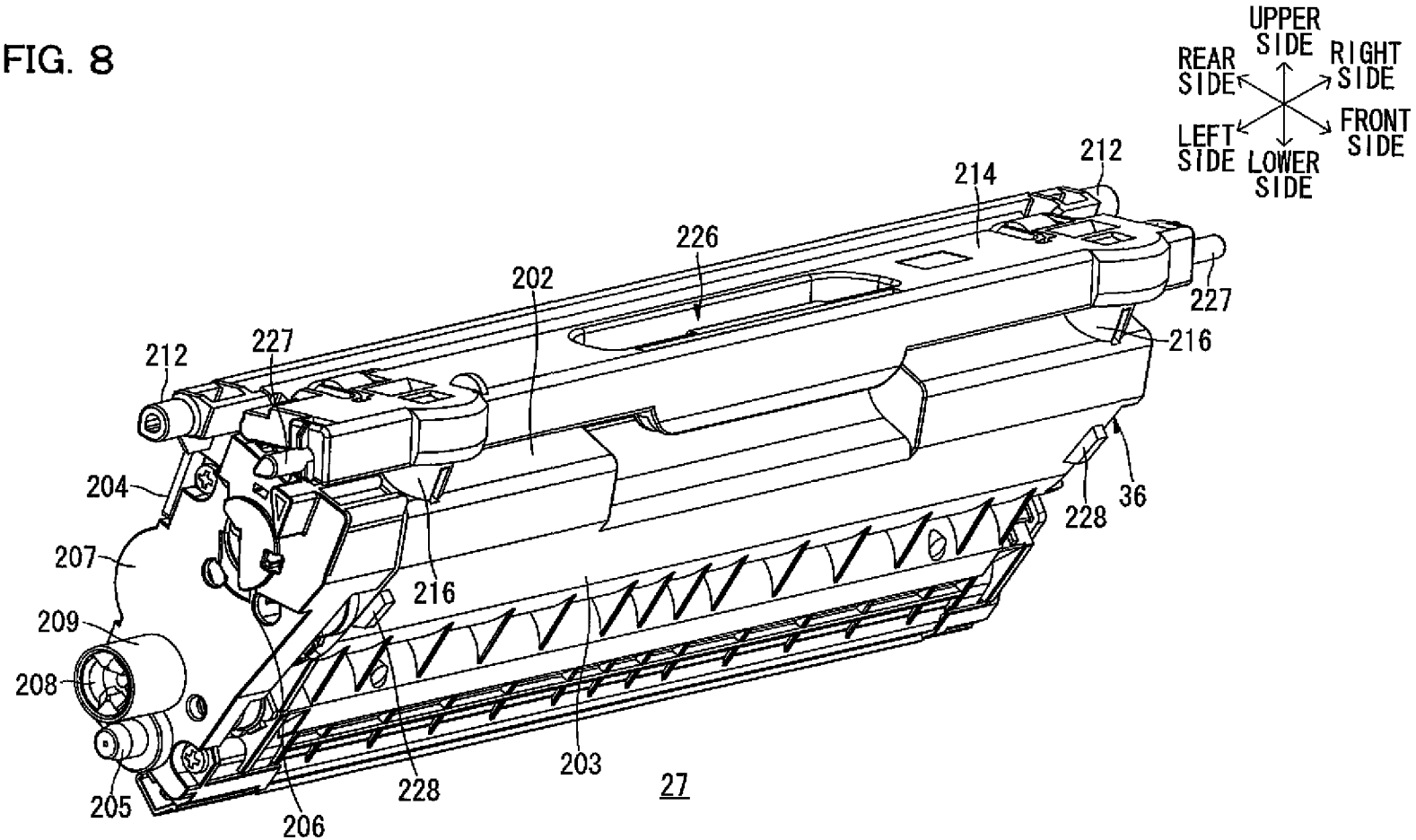
FIG. 8 is a perspective view of the developer cartridge shown in FIG. 1, as viewed from left front, showing the handle which is in the tilted position.
Figure 9:
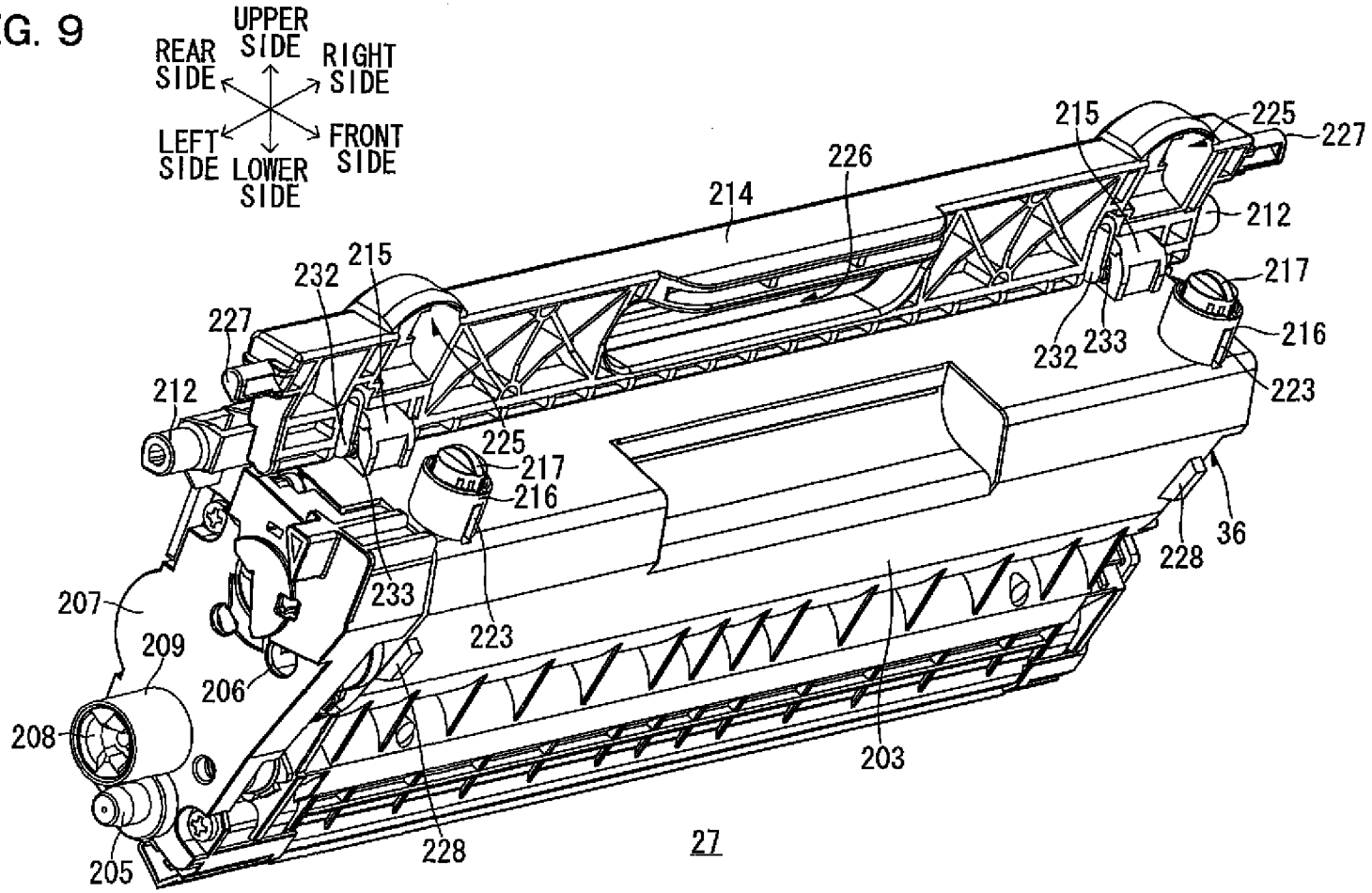
FIG. 9 is a perspective view of the developer cartridge shown in FIG. 1, as viewed from left front, showing the handle which is in the standing position.
Figure 10:
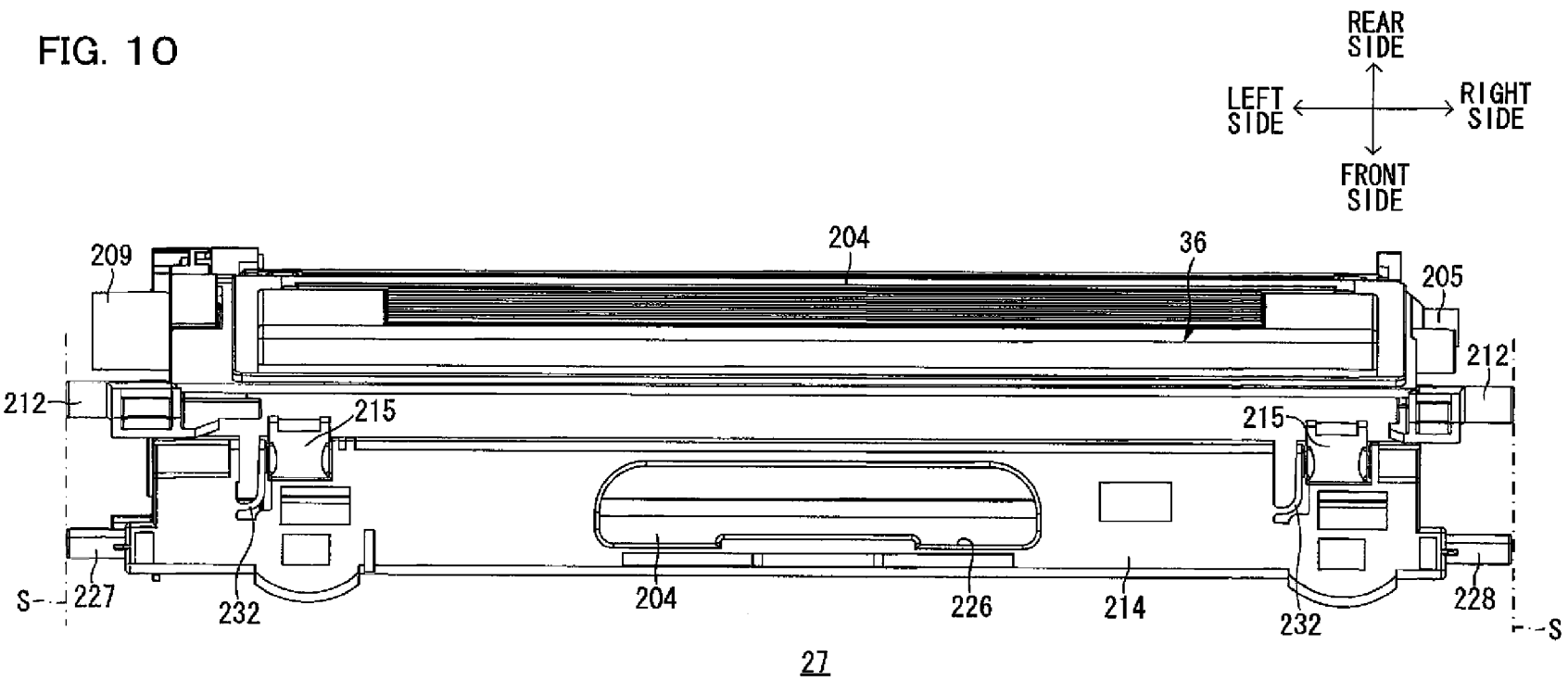
FIG. 10 is a plan view of the developer cartridge shown in FIG. 1.
Figure 11:
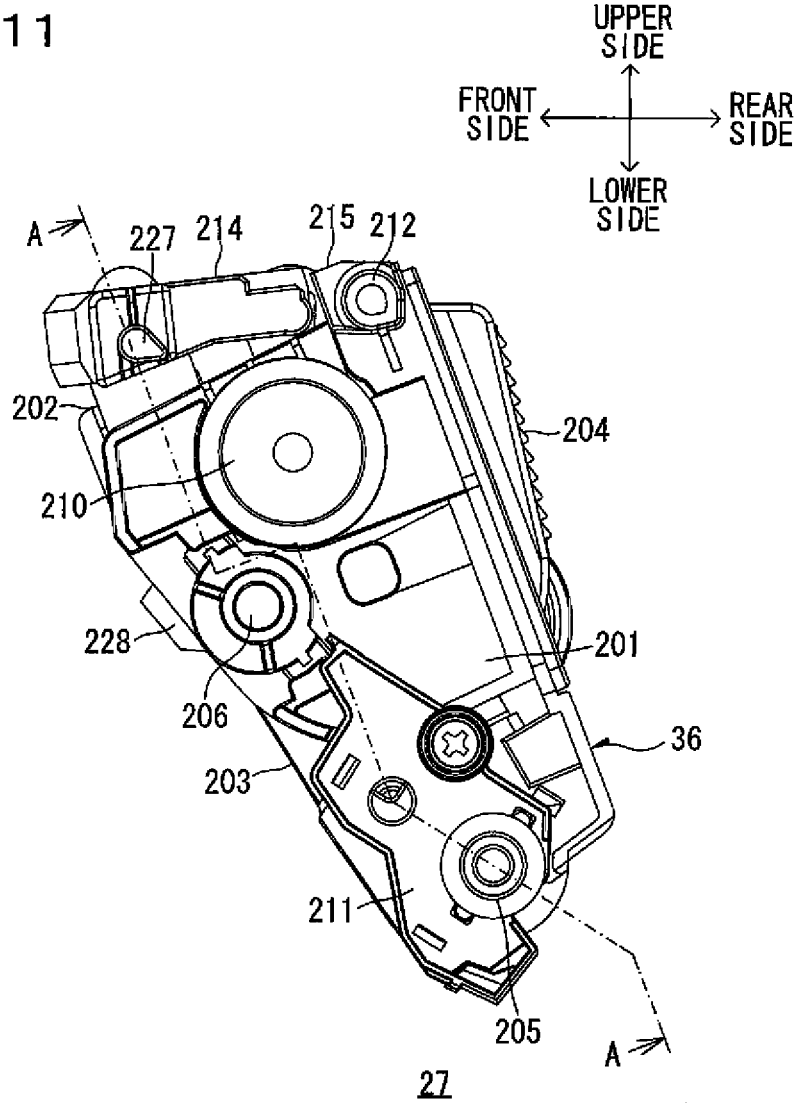
FIG. 11 is a right-side view of the developer cartridge shown in FIG. 1.
Figure 12:
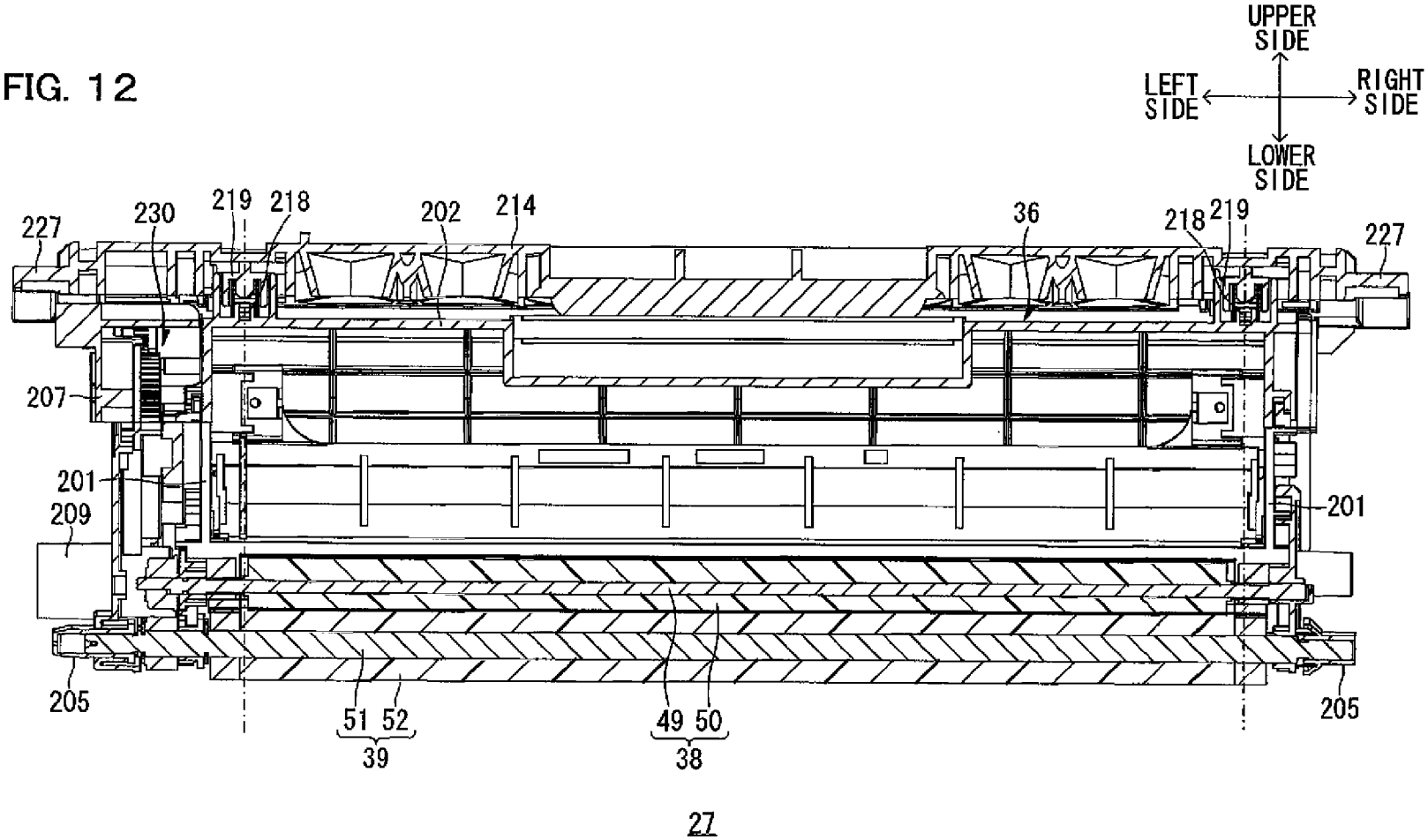
FIG. 12 is a sectional view sectioned along line A-A of FIG. 11.
Figure 13:
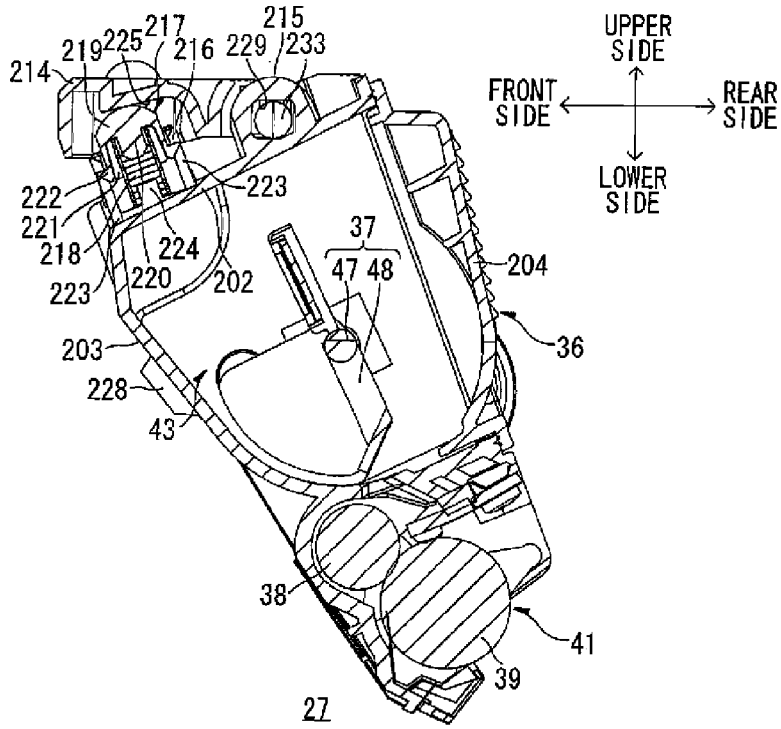
FIG. 13 is a right-side sectional view of the developer cartridge shown in FIG. 1, showing the handle which is in the tilted position.
Figure 14:
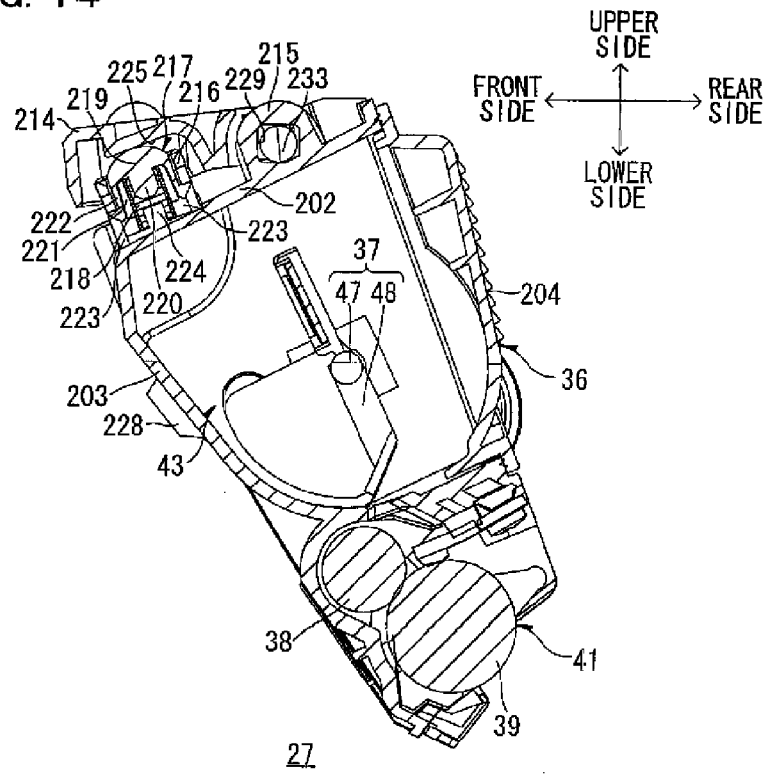
FIG. 14 is a right-side sectional view of the developer cartridge shown in FIG. 1, showing the handle which is in the pressed position.

FIGS. 6 and 7 are perspective views of the developer cartridge 27, as viewed from above and left rear. FIGS. 8 and 9 are perspective views of the developer cartridge 27, as viewed from left front. FIG. 10 is a plan view of the developer cartridge 27. FIG. 11 is a right-side view of the developer cartridge 27 and FIG. 12 is a sectional view sectioned along line A-A of FIG. 11. Further, FIGS. 13 and 14 are right-side sectional views of the developer cartridge 27. FIGS. 13 and 14 are simplified illustration of the feed roller 38 and the developing roller 39.

(1) Developer Cartridge

The developer frame 36 of the developer cartridge 27 integrally comprises a pair of side walls 201 opposing to each other in the widthwise direction, an upper wall 202 extended between upper edges of the both side walls 201, a front wall 203 extended between front edges of the both side walls 201, and a rear wall 204 extended between rear edges of the both side walls 201. An opening 41 via which the developing roller 39 is exposed is defined by lower edges of the both side walls 201, front wall 203, and rear wall 204.

Windows 206 for detecting a remaining amount of toner accommodated in the toner accommodating chamber 43 are embedded in the both side walls 201. These windows 206 are opposed to each other across the toner accommodating chamber 43 to allow light for detecting a remaining amount of toner to pass through in the widthwise direction.

A gear mechanism section covered by a gear cover 207 is provided on the left-side side wall 201, as shown in FIGS. 6 to 9. This gear mechanism section includes a coupling passive gear 208 exposed from the gear cover 207 and a gear train 230 (see FIG. 12) meshed with the coupling passive gear 208 within the gear cover 207.

The gear cover 207 has a cylindrical gear-arrangement portion 209 formed at a lower end portion thereof projecting in a widthwise outward direction. The coupling passive gear 208 is arranged in the gear-arrangement portion 209 and exposed from a front end surface of the gear-arrangement portion 209.

A coupling shaft (not shown) provided in the main body casing 2 is coupled with the coupling passive gear 208 in such a manner as to be movable rear and forth and non-rotatable relative to the coupling passive gear 208. A driving force of a motor (not shown) in the main body casing 2 is input to the coupling passive gear 208 from the coupling shaft.

The gear train 230 includes an agitator driving gear fixed to the rotating shaft 47 of the agitator 37, a feed roller driving gear fixed to the feed roller shaft 49 of the feed roller 38, and a developing roller driving gear fixed to the developing roller shaft 51 of the developing roller 39. These gears are meshed with the coupling passive gear 208 via intermediate gears and the like. A driving force input to the coupling passive gear 208 is transmitted to the agitator 37, the feed roller 38, and the developing roller 39 via the gear train 230.

A cap 210 for closing a toner filling port (not shown) for filling the toner in the toner accommodating chamber 43 is arranged above the window 206 in the right-side side wall 201, as shown in FIG. 11.

Further, the right-side side wall 201 is provided, at a lower end portion thereof, with a bearing member 211 for supporting a right end portion of the developing roller shaft 51 in a rotatable manner. As shown in FIG. 12, the right end portion of the developing roller shaft 51 is rotatably inserted through the bearing member 211 and the left end portion of the developing roller shaft 51 is rotatably inserted through the left-side side wall 201, whereby the developing roller shaft 51 is rotatably supported on the developing frame 36. The left end portion and the right end portion of the developing roller shaft 51 project widthwise outwardly from the gear cover 207 and the bearing member 211, respectively. The both end portions of the developing roller shaft 51 are covered by collar members 205, respectively.

The both side walls 201 are provided, at upper end portions thereof, with detaching lugs 212 serving as second engaging portions in a generally cylindrical form, as shown in FIGS. 6 to 9. The detaching lugs 212 project widthwise outwardly from connecting portions of the side walls 201 with the upper end portions of the rear wall 204.

A handle 214 to be gripped in moving the developer cartridge 27, which serves also as a pressing member, is provided on the upper wall 202. The handle 214 is configured in a widthwise elongated thin plate form. The handle 214 can swingably shift to a standing position where the handle 214 stands up to a position substantially orthogonal to the upper wall 202 (see FIGS. 7 and 9), a tilted position where the handle 214 is tilted forwardly from the standing position into close proximity to the upper wall 202 (see FIGS. 6, 8 and 14), and a pressing position where the handle 214 is brought into further closer proximity to the upper wall 202 from the tilted position (see FIG. 14).

To be more specific, handle bearing portions 215 formed in a generally semicircular form, as viewed from side elevation, projecting upwards are integrally formed at both widthwise end portions of the rear end portion of the upper wall 202, as shown in FIGS. 13 and 14. Through holes 229 extending through the handle bearing portions 215 in the widthwise direction are formed in the handle bearing portions 215. On the other hand, cut away portions 231 in which the handle bearing portions 215 can be fitted are formed at both widthwise end portions of the rear end portion of the handle 214, as shown in FIGS. 6 and 7. An elastically deformable portion 232 formed in generally L-shape as viewed from top whose base end portion is connected to a left side surface of the cut away portion 231 is arranged in each cut away portion 231. The elastically deformable portion 232 is arranged so that its free end portion is disposed opposite to and spaced apart from a right side surface of the cut away portion 231 in the widthwise direction. The handle bearing portions 215 is fitted in between the free end portion of the elastically deformable portion 232 and the right side surface of the cut away portion 231. The free end portion of the elastically deformable portion 232 and the right side surface of the cut away portion 231 are respectively provided with support shafts 233 projecting in a direction of coming close to each other. The elastically deformable portion 232 is elastically deformed to expand the space between the support shafts 233 and then, the handle bearing portions 215 are fitted in the cut away portion 231. Thereafter, the elastic deformation of the elastically deformable portion 232 is released and thereby the support shafts 233 are inserted in the through holes 229 of the handle bearing portions 215. As a result of this, the handle 214 is swingably mounted on the handle bearing portions 215.

Cylindrical spring guide members 216 are formed on the front end portion of the upper wall 202 at both end portions thereof in the widthwise direction (an axial direction of developing roller 39), respectively, at a widthwise spaced relation substantially equal to a widthwise length (an axial length) of the rubber roller 52 of the developing roller 39, as shown in FIGS. 9 and 12. The respective spring guide members 216 are arranged opposite to and spaced apart from the handle bearing portions 215 in the front and rear direction and also oppose to the both widthwise end portions of the rubber rollers 52 of the developing roller 39. A vertically retractable abutment member 217 and a coiled spring 218 for biasing the abutment member 217 upwards constantly are provided in an interior of each spring guide member 216, as shown in FIGS. 13 and 14.

The abutment member 217 integrally comprises a body portion 219 formed in a generally circular form, as viewed from top, whose upper surface is curved convexly, a boss portion 220 projecting downwardly from a central portion of a bottom surface of the body portion 219, and a cylindrical extending portion 221 extending along an inside surface of the spring guide member 216 from a marginal portion of the bottom surface of the body portion 219. A plurality of engaging pawl portions 222 are formed in the extending portion 221. The engaging pawl portions 222 are fitted in grooves 223 formed in the spring guide member 216, respectively, so that front end portions of the engaging pawl portions 222 are held by upper end portions of the grooves 223 to prevent the abutment member 217 from being released from the spring guide member 216.

The coiled spring 218 is provided between the abutment member 217 and the upper wall 202 in the compressed state by inserting a spring mounting boss 224 formed on the upper wall 202 in a lower end portion of the coiled spring 218 and inserting the boss 220 of the abutment member 217 in an upper portion of the coiled spring 218.

Recesses 225 to be able to receive the corresponding abutment members 217 are formed on a lower surface of the handle 214 (surface opposite to the upper wall 202) at locations corresponding to the abutment members 217, as shown in FIG. 9. When the handle 214 is put in the tilted position, the abutment members 217 are received in the recesses, respectively, so that front ends of the abutment members 217 are brought into abutment with bottoms of the recesses 225 (bottom surfaces of the handle 214), respectively.

The handle 214 has a widthwise elongated rectangular grip opening 226, as viewed from top, formed in a widthwise center portion thereof, as shown in FIG. 10. The grip opening 226 can facilitate the grip of the handle 214 by putting the user's fingers in the grip opening 226.

Further, the handle 214 has generally columnar pressing lugs 227 as viewed from side elevation, serving as a first engaging portion, formed at the both widthwise end portions of a front end portion thereof. The pressing lugs 227 project widthwise outwardly from the both widthwise end portions of the handle 214, respectively. The pressing lugs 227 are formed to have a length so that its front end surfaces are on a plane S common with front end surfaces of detaching lugs 212 projecting in the same direction, as shown in FIG. 10. In other words, the pressing lugs 227 are located in the plane of the front end surfaces of the detaching lugs 212 projecting in the same direction as the front end surfaces of the pressing lugs 227 with respect to the widthwise direction. The pressing lugs 227 are located lower than the detaching lugs 212 when the developer cartridge 27 is mounted in the drum subunit 28 and the handle 214 is tilted, as shown in FIG. 11.

Supported projections 228 formed in a generally trapezoidal form, as viewed from side elevation, projecting forward are formed on the front wall 203 at both widthwise end portions thereof, as shown in FIGS. 8 and 9.

(2) Mounting and Dismounting of Developer Cartridge to and from Drum Unit

The developer cartridge 27 for the corresponding color is mounted to the corresponding drum subunit 28 from above the drum unit 26, by holding the handle 214 with one's fingers entering the grip opening 226 of the handle 214, as shown in FIG. 4.

To be more specific, the collar members 205 provided at both axial end portions of the developing roller shaft 51 of the developer cartridge 27 are inserted in the guide grooves 106 in the side frames 104 of the corresponding drum subunit 28 and then the developer cartridge 27 is pressed down to the drum subunit 28 along the guide grooves 106. When the developing roller 39 is brought into contact with the photosensitive drum 29, the further pressing of the developer cartridge 27 is stopped. Then, the developer cartridge 27 is pivoted about the developing roller shaft 51 and is tilted under its own weight in a direction in which an upper end portion of the developer cartridge 27 leans against the center frame 105 on the front side. Then, the supported projections 228 formed on the front wall 203 of the developing frame 36 are brought into abutment with the supporting rollers 110 of the center frame 105 and are supported by the supporting rollers 110. As a result of this, the developer cartridge 27 is positioned with respect to the drum subunit 28, with which the mounting of the developer cartridge 27 to the drum subunit 28 is completed.

When the user releases the hold of the handle 214 in the standing position after the mounting of the developer cartridge 27, the handle 214 is pivoted about the pivot shaft 233 and tilted from the standing position to the tilted position under the own weight.

When all the developer cartridge 27 are mounted in the related drum subunits 28, the near-side grip 111 of the front beam 101, the handles 214 of the developer cartridges 27, and the far-side grip 113 of the rear beam 113 are arranged to overlap with each other in the front and rear direction, as shown in FIG. 3.

On the other hand, when the developer cartridge 27 is in the state of being mounted in the drum unit 26 (drum subunit 28), the handle 214 can be held with one's hand, shifted from the tilted position to the standing position and lifted up, whereby the developer cartridge 27 can be dismounted from the drum unit 26.

4. Rails and Detaching and Pressing Mechanism

Figure 15:
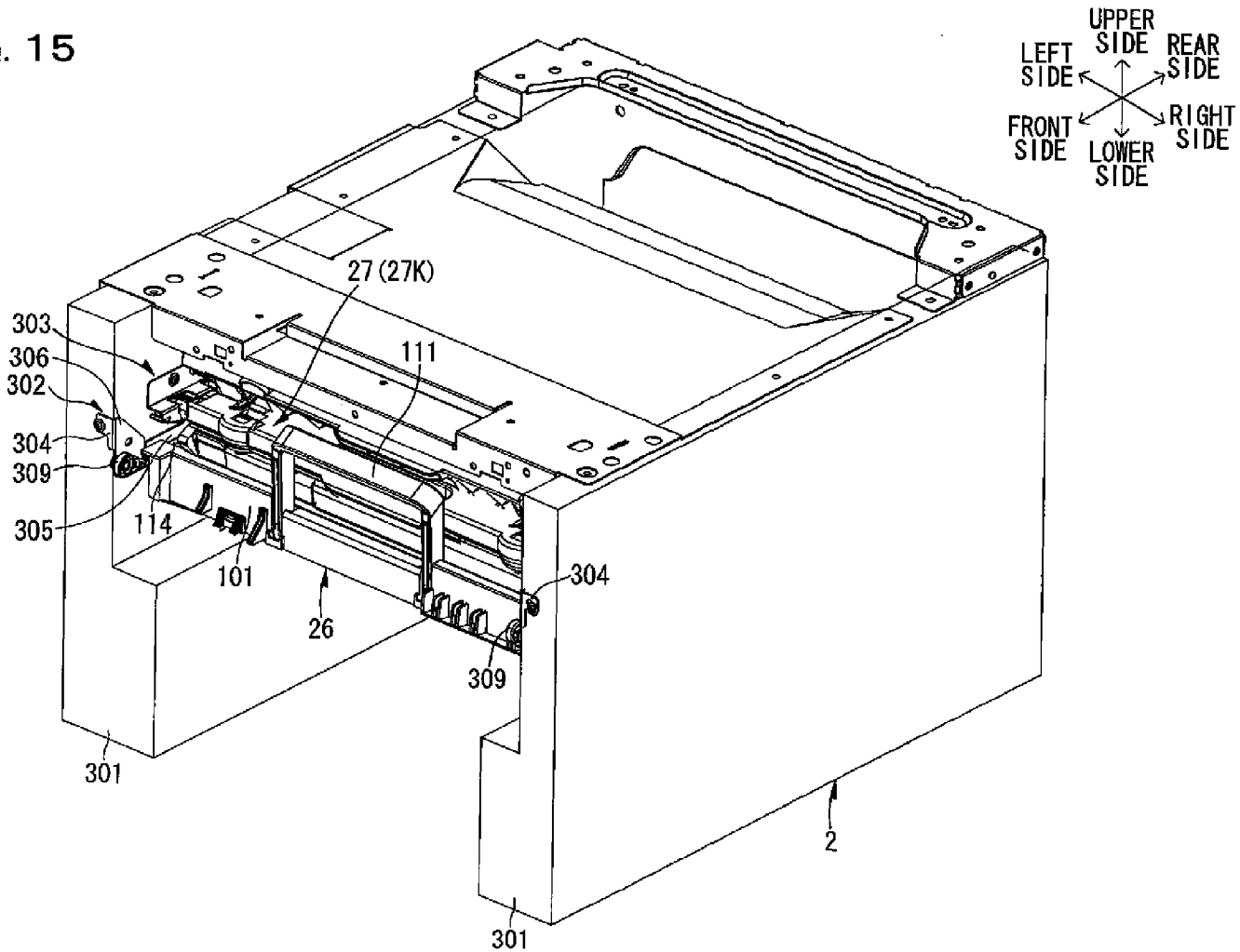

FIG. 15 is perspective view of the main body casing 2 and the drum unit 26, as viewed from above and right front, showing the main body casing 2 from which the exterior plate and the front cover 9 are removed and in which the drum unit 26 is mounted.

The main body casing 2 comprises a pair of main body frames 301 disposed opposite to each other across the drum units 26 in the widthwise direction. The main body frames 301 are provided, on inner side surfaces thereof, with rails 302 for guiding the mounting and dismounting of the drum units 26, and detaching and pressing mechanisms 303 for detaching and pressing the developing roller 39 of the developer cartridge 27 mounted in the drum unit 26 from and onto the photosensitive drum 29 (for shifting the developer cartridge 28 to the contact position and to the detached position and also pressing the developer cartridge 28 onto the photosensitive drum 29 in the contact position).

In FIG. 15, only the detaching and pressing mechanism 303 on the left side is shown.

Figure 16:
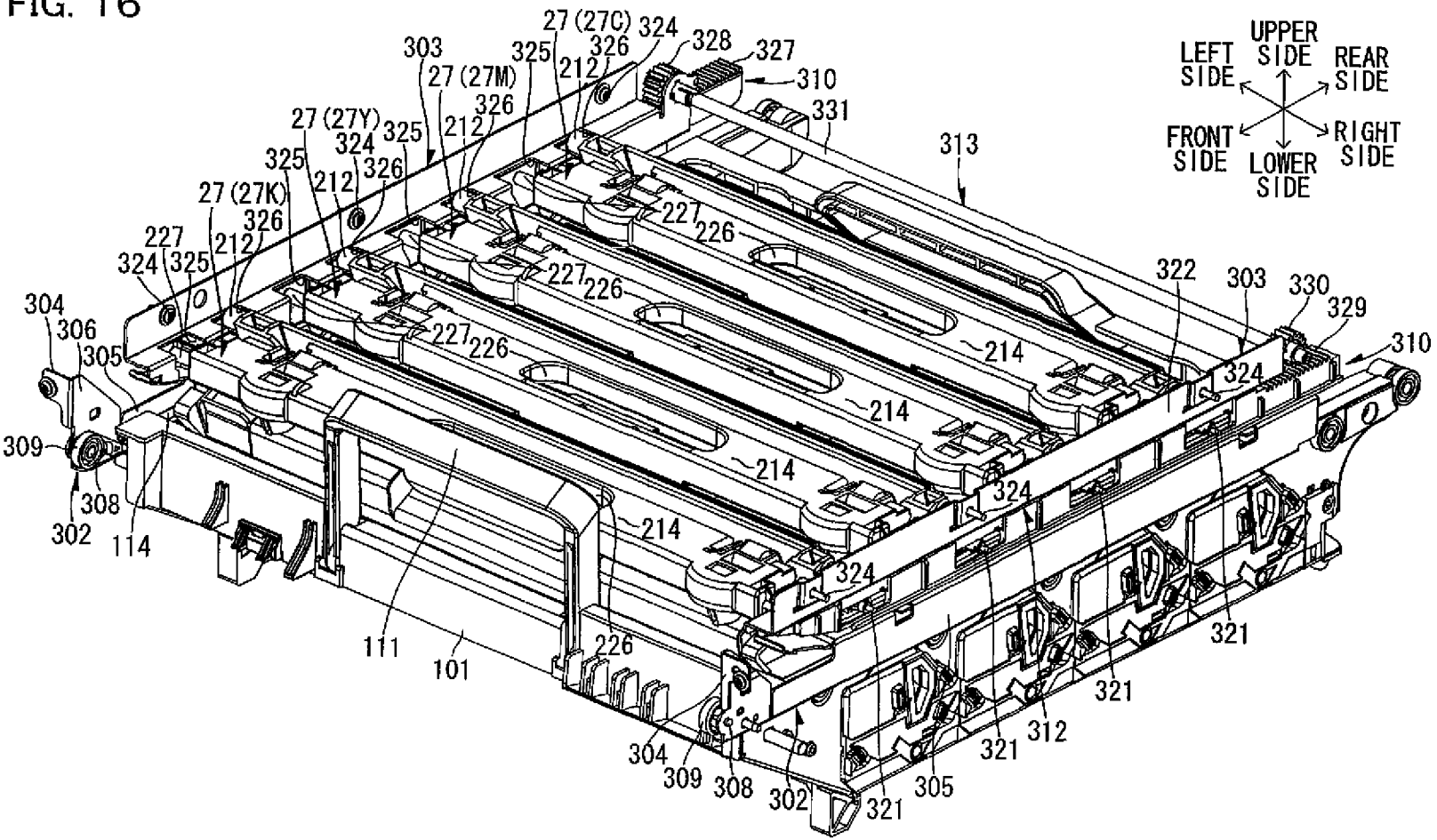
FIG. 16 is a perspective view showing the drum unit shown in FIG. 15, right and left rails and a detaching and pressing mechanism, as viewed from above and right front.
Figure 17:
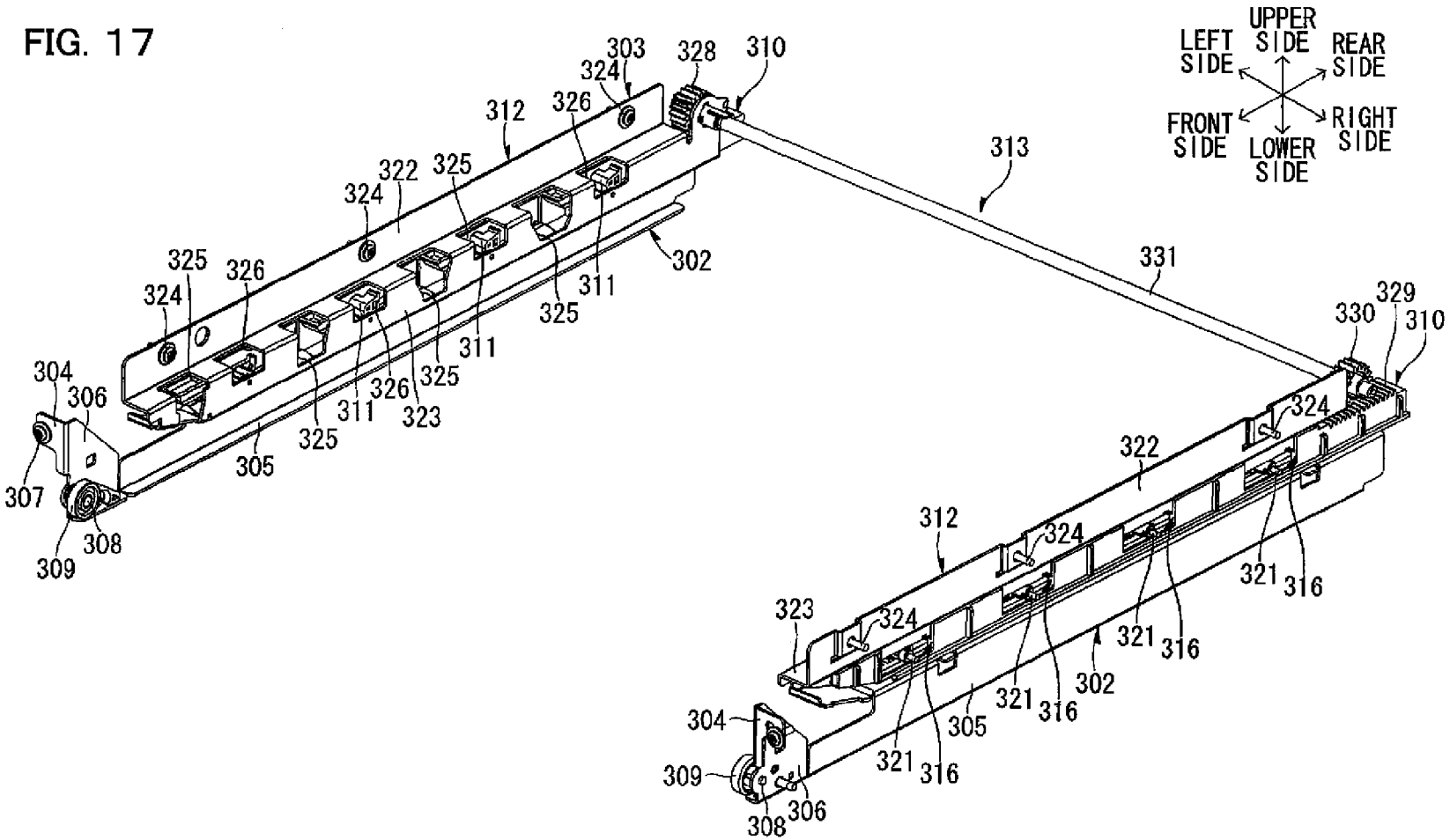
FIG. 17 is a perspective view showing the rails and the detaching and pressing mechanism shown in FIG. 16, as viewed from above and right front.

FIG. 16 is a perspective view showing the drum unit 26, the right and left rails 302, and the detaching and pressing mechanism 303, as viewed from above and right front. FIG. 17 is a perspective view, as viewed from above and right front, showing the left and right rails 302 and the detaching and pressing mechanism 303.

(1) Rails

The left and right rails 302 are disposed opposite to each other across the drum units 26 in the widthwise direction. Each rail 302 integrally comprises a rail fixing portion 304 disposed to oppose to a front end surface of the main body frame 301, a rail body portion 305 extending in the front and rear direction (horizontal direction) along the inner side surface of the main body frame 301, and a connecting portion 306 for connecting the rail fixing portion 304 and the rail body portion 305 to each other.

The rail fixing portion 304 is fixed to the front end surface of the main body frame 301 by a screw 307.

The rail body portion 305 is formed in a generally L-shape bent widthwise inwardly at a lower end portion thereof. The flanged portions 114 of the respective side plates 103 of the drum unit 26 are put on horizontally extended portions of the rail body portions 305 in the state in which the drum unit 26 is mounted in the main body casing 2.

The connecting portion 306 is configured to connect a widthwise inner edge of the rail fixing portion 304 and a front edge of the rail body portion 305 with each other. A rolling member supporting shaft 308 extends widthwise through and is supported by the connecting portion 306. Rail rolling members 309 rotatably supported by the rolling member supporting shaft 308 are disposed opposite to each other on the widthwise inner surface of the connecting portion 306. A top end of the periphery of the rail rolling member 309 is located higher than a lower end portion (the horizontally extended portion) of the rail body portion 305.

(2) Mounting of Drum Unit to Main Body Casing

When the drum unit 26 is mounted to the main body casing 2, the near-side grip 111 and the far-side grip of the drum unit 26 (see FIG. 3) are first griped with both hands and the drum unit 26 is lifted up. On the other hand, the front cover 9 is tilted to open the mounting port 8, as seen by reference to FIG. 1. Then, the drum unit 26 is made to enter from the mounting port 8 into the drum accommodating room 7.

At this time, the respective rolling members 118 provided at the rear end portion of the drum unit 26 are rolled on the rail body portion 305 of the rail 302. By releasing one'grip of the far-side grip 113, the both flanged portions 114 of the drum unit 26 are put on the left and right rail rolling members 309, respectively. When the drum unit 26 is pressed rearwards in this state, the respective rolling members 118 roll over the rail body portions 305 and also the flanged portions 114 slide over the respective rail rolling members 309, thus allowing smooth movement of the drum unit 26. Further, the detaching lugs 212 and pressing lugs 227 of the each developer cartridge 27 slide over a cam accommodating portion 323 of a holder fixing portion 322 described later.

Then, when the rolling members 118 are dropped off to the rear side from the rails 302 and also the flanged portions 114 are dropped off to the rear side from the rail rolling members 309 and are put on the horizontally extended portions of the rail body portions 305, the pressing lugs 227 and the detaching lugs 212 of the respective developer cartridge 27 are received in pressing lug receiving portions 325 and detaching lug receiving portions 326 described later, respectively, with which the mounting of the drum unit 26 to the main body casing 2 is completed.

Thereafter, one's grip of the near-side grip 111 is released, the front cover 8 is closed and thereby the mounting port 8 is closed by the front cover 9. In association with this closing operation of the front cover 9, the near-side grip 111 is pivoted about the support shaft 112 from the standing position (see FIG. 4) to the accommodated position (see FIG. 3).

(3) Detaching and Pressing Mechanism

The detaching and pressing mechanism 303 comprises a pair of translation cam members 310, intermediate members 311 arranged in correspondence with the respective translation cam members 310, cam holders 312 for respectively holding the translation cam members 310 in a linearly movable manner in the front and rear direction, and a synchronous movement mechanism 313 for allowing the pair of translation cam members 310 to linearly move in synchronization, as shown in FIG. 17.

Figure 18:
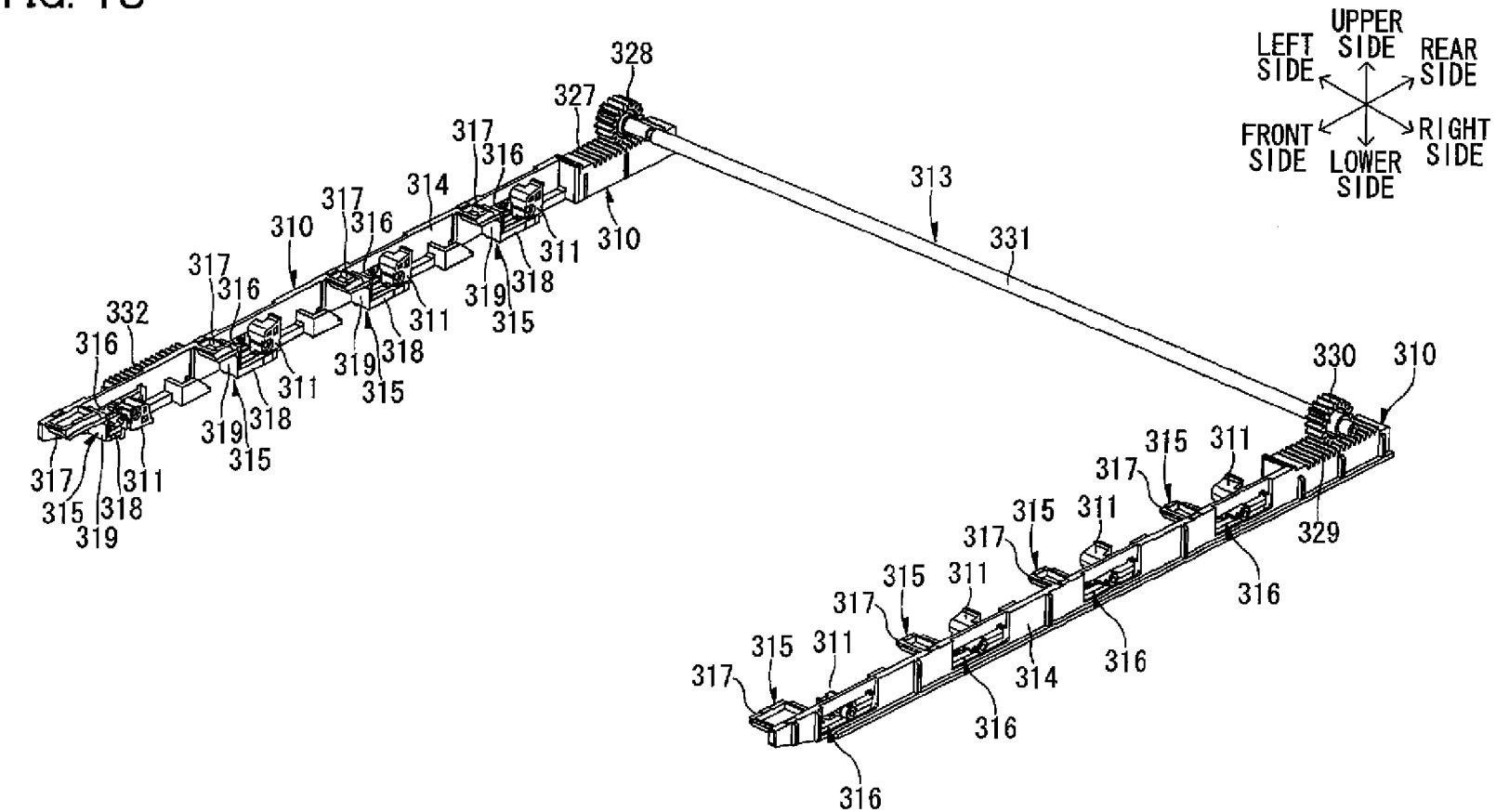
FIG. 18 is a perspective view showing translation cam members, intermediate members, and a synchronous movement mechanism shown in FIG. 17, as viewed from above and right front.
Figure 19:
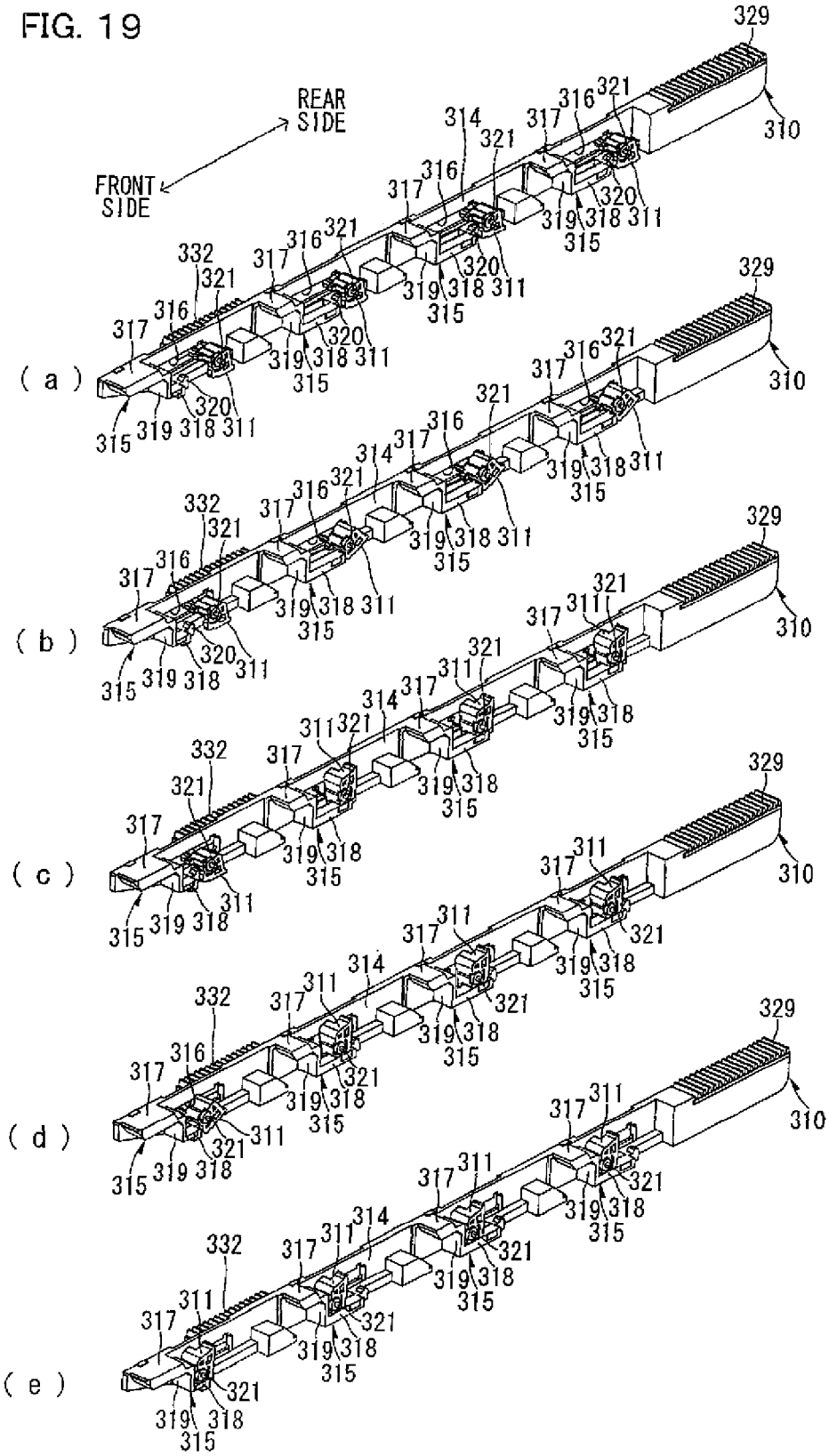
FIG. 19 is a perspective views for explaining movements of the translation cam members and the intermediate members shown in FIG. 18.
Figure 20:
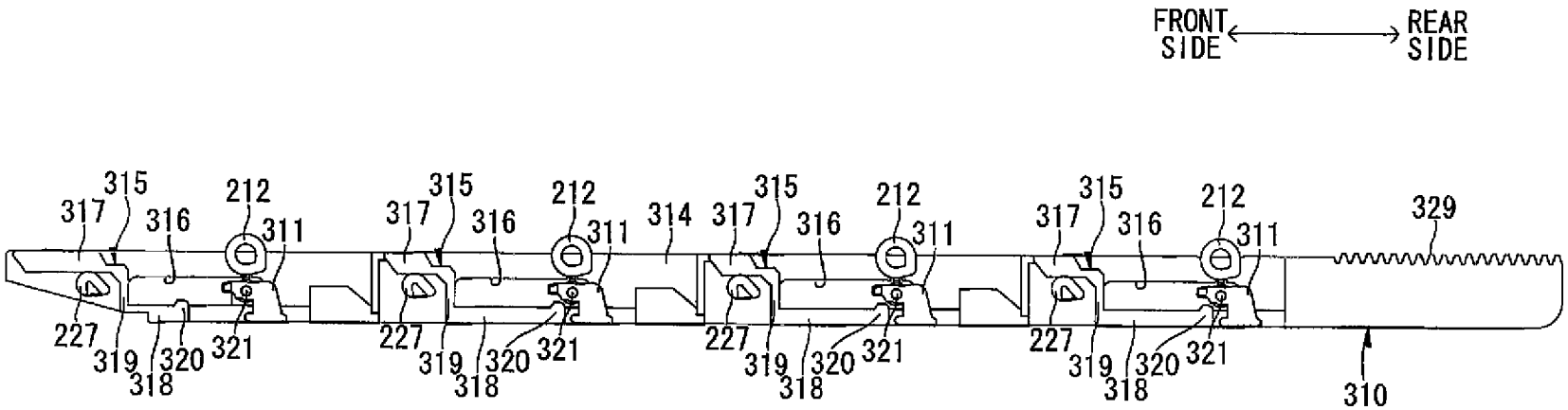
FIG. 20 is a right-side view showing the translation cam members and the intermediate members which are in the state of FIG. 19(*a*).
Figure 21:
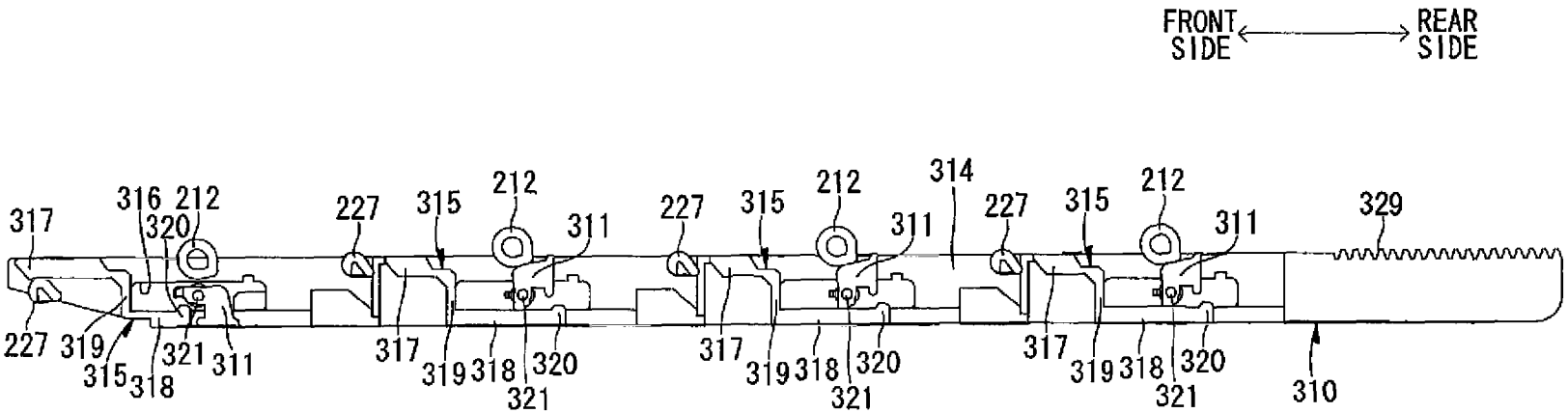
FIG. 21 is a right-side view showing the translation cam members and the intermediate members which are in the state of FIG. 19(*c*).
Figure 22:
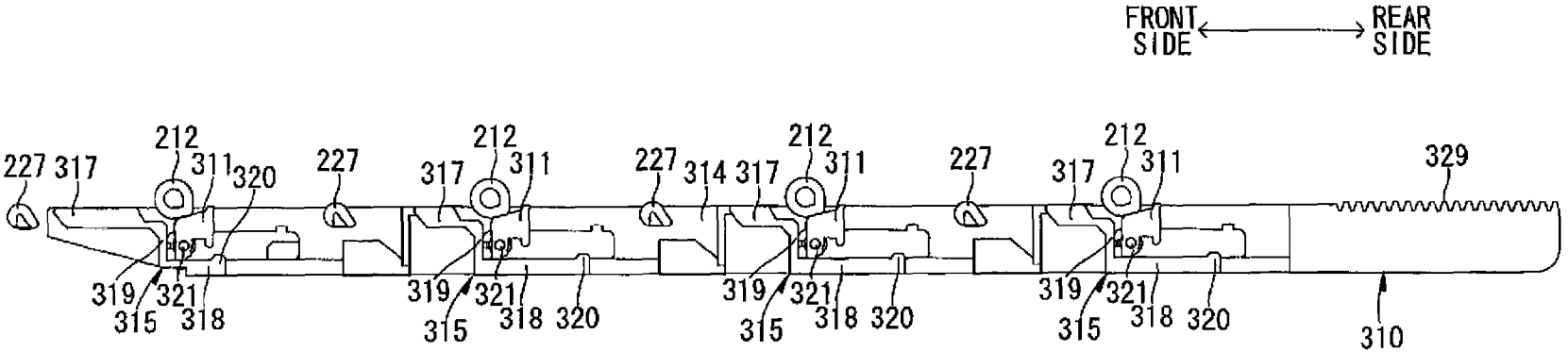
FIG. 22 is a right-side view showing the translation cam members and the intermediate members which are in the state of FIG. 19(*e*).

FIG. 18 is a perspective view, as viewed from above and right front, showing the translation cam members 310, the intermediate members 311, and the synchronous movement mechanism 313. In FIG. 18, the cam holder 312 is omitted and there is shown a perspective view of the detaching and pressing mechanism 303 as viewed from above and right front. FIG. 19 is a perspective view for explaining movements of the translation cam members 310 and the intermediate members 311. Further. FIG. 20 is a right-side view showing the translation cam members 310 and the intermediate members 311 which are in the state of FIG. 19(*a*). FIG. 21 is a right-side view showing the translation cam members 310 and the intermediate members 311 which are in the state of FIG. 19(*c*). FIG. 22 is a right-side view showing the translation cam members 310 and the intermediate members 311 which are in the state of FIG. 19(*e*).

Each translation cam member 310 comprises a cam body plate 314 formed in a thin plate form extending in front and rear direction along the inner side surface of the main body frame 301 (see FIG. 15), and four operating members 315 provided on widthwise inner side surface of the cam body plate 314.

Four rectangular holes 316 formed in a longitudinally elongated, generally rectangular form are formed at equal spaces in front and rear direction in the cam body plate 314.

The four operating members 315 are respectively located on the front side of the four rectangular holes 316. Each operating member 315 integrally comprises a press operating portion 317 for pressing down the pressing lugs 227 of the developer cartridge 27, and a contacting/detaching operating portion 318 for allowing the intermediate members 311 to pivot as described later, and a connecting portion 319 for connecting a rear end portion of the press operating portion 317 and a front end portion of the contacting/detaching operating portion 318 to each other. The press operating portion 317 is configured in a crank form as viewed from side elevation, extending along an upper edge of the cam body plate 314. The contacting/detaching operating portion 318 extends along a lower edge of the cam body plate 314.

The contacting/detaching operating portion 318 has, at a rear end portion thereof, an upward protrusion 320 serving as an operating portion, as shown in FIGS. 20 to 22.

The foremost operating member 315 is different in shape from the other three operating members 315 (which are hereinafter referred to as "three rear-side operating members 315"). Specifically, the press operating portion 317 of the foremost operating member 315 is formed to be longer in the front and rear direction than the press operating portions 317 of the three rear-side operating members 315. Further, the contacting/detaching operating portion 318 of the foremost operating member 315 is formed to be smaller in the front and rear direction than the contacting/detaching operating portions 318 of the three rear-side operating members 315. This difference in configuration (dimension) can produce the result that the developing rollers 39 of all the developer cartridges 27 can be pressed on the corresponding photosensitive drums 29 or only the developing roller 39 of the black developer cartridge 27K can be pressed on the corresponding photosensitive drum 29, or the developing rollers 39 of all the developer cartridges 27 can be detached from the corresponding photosensitive drums 29.

The four intermediate members 311 are respectively arranged on the rear side of the four operating members 315 and disposed opposite to the four rectangular holes 316 in the widthwise direction, respectively. The respective intermediate members 311 are in a generally L-shape, as viewed in side elevation, and is the form of a block having a thickness in the widthwise direction, as shown in FIGS. 20 to 22. Each intermediate member 311 is rotatably supported by an intermediate member supporting shaft 321 extending widthwise through one end portion of the intermediate member 311. When each intermediate member 311 is in non-contact with the contacting/detaching operating portion 318 (see FIG. 20), a lower end portion of the intermediate member 311 is located opposite to and spaced apart from the protrusion 320 of the contacting/detaching operating portion 318 in the front and rear direction.

The intermediate member supporting shafts 321 are spaced apart from each other in the front and rear direction at equal spaced intervals (which are equal to the intervals between the detaching lugs 212 when the four developer cartridges 27 is mounted in the drum units 26), as shown in FIG. 18. The intermediate member supporting shafts 321 are inserted through the rectangular holes 316, which confront the intermediate members 311 supported by the intermediate member supporting shafts 321, and is extended widthwise outwardly of the cam body plate 314. The intermediate member supporting shafts 321 are non-rotatably supported by the cam holder 312 at widthwise inner end portions thereof.

The cam holder 312 integrally comprises a holder fixing portion 322 formed in a thin plate form extending in the front and rear direction along the inner side surface of the main body frame 301, and the cam member accommodating portion 323 extending continuously from a lower edge of the holder fixing portion 322, as shown in FIG. 17.

The holder fixing portion 322 is fixed to the inner side surface of the main body frame 301 by a screw 324.

The cam accommodating portion 322 is formed in a generally flat-bottomed U-shape in section extending widthwise inwardly from the overall length of the lower edge of the holder fixing portion 322, then bending downwardly, and further bending widthwise outwardly. The cam accommodating portion 322 has four pressing lug receiving portions 325 being receivable the pressing lugs 227 of the developer cartridge 27 and four detaching lug receiving portions 326 being receivable the detaching lugs 212 of the developer cartridge 27, which are formed in an alternate order by cutting away the cam accommodating portion 323 continuously from an upper surface thereof to a widthwise inner side surface thereof. Specifically, the four pressing lug receiving portions 325 are formed in the cam accommodating portion 323 at anteroposteriorly spaced places equal to spaces between the pressing lugs 227 of the developer cartridge 27 in the state of being mounted in the drum unit 26. Further, the four detaching lug receiving portions 326 are formed at anteroposteriorly spaced places equal to spaces between the detaching lugs 212 of the developer cartridge 27 in the state of being mounted in the drum unit 26. The respective detaching lug receiving portions 326 are located behind the respective pressing lug receiving portions 325. When the detaching lugs 212 are respectively received in the detaching lug receiving portions 326, the detaching lugs 212 are respective put in the state of opposing to the intermediate member 311 from above.

The synchronous movement mechanism 313 is structured so that following the linear movement of the left translation cam member 310, a driving force required for the linear movement can be transmitted from the left translation cam member 310 to the right translation cam member 310.

That is, the synchronous movement mechanism 313 comprises a left-side rack gear 327, serving as a first rack gear, formed on the top surface of the rear end portion of the left-side translation cam member 310, a left-side pinion gear 328, serving as a first pinion gear, meshed with the left-side rack gear 327, a right-side rack gear 329, serving as a second rack gear, formed on the top surface of the rear end portion of the right-side translation cam member 310, a right-side pinion gear 330, serving as a second pinion gear, meshed with the right-side rack gear 329, and a connection shaft 331 fixed to the left-side pinion gear 328 and the right-side pinion gear 330 in a relatively non-rotatable manner, as shown in FIG. 18.

The left-side translation cam member 310 is provided, on a widthwise outer side surface of the cam body plate 314, with an input rack gear 332 to which a driving force of a motor, not shown, is input.

(4) Detaching and Pressing Operation

Referring primarily to FIGS. 19 to 22, the operation of the detaching and pressing mechanism 303 is described.

As shown in FIGS. 19(*a*) and 20, when the translation cam member 310 is shifted in the foremost position, the contacting/detaching operating portions 318 of the operation members 315 and the intermediate members 311 located behind them are respectively placed opposite to each other at anteroposteriorly spaced locations in a non-contact manner. A space is formed between the contacting/detaching operating portion 318 of the foremost operation member 315 and the intermediate member 311 behind it. This space is larger than the spaces between the contacting/detaching operating portions 318 of the three rear-side operating members 315 and the intermediate members 311 respectively located behind them.

In this state, the each developer cartridge 27 is located at the contact position where the developing roller 39 and the photosensitive drum 29 contact with each other. Further, the press operating portion 317 of each operating member 315 is brought into abutment with the pressing lug 227 of each developer cartridge 27 from above to press the pressing lug 227 downward. By pressing the pressing lug 227 downward, the handle 214 of the developer cartridge 27 is pivoted about the support shaft 233 and is put in a pressed state, as shown in FIG. 14. As a result, the abutment member 217 is pressed down by the handle 214 (recess 225), so that the coiled spring 218 is compressed. Then, a biasing force of the coiled spring 218 resulting from the compression is input to the upper wall 202 of the developer frame 36 and thereby the developer frame 36 is biased downwardly, so that the developing roller 39 is pressed on the photosensitive drum 29. At this time, the biasing force generated by the coiled spring 218 is in the range of not less than 1N to not more than 20N.

In this state, when a driving force of the motor (not shown) is input to the input rack gear 322 and the left-side translation cam member 310 is moved rearwards, the left-side pinion 328 is rotated following the movement of the left-side translation cam member 310. The rotation of the left-side pinion gear 328 is transmitted to the right-side pinion gear 330 through the connection shaft 331, so that the right-side pinion gear 330 is rotated in the same direction as the left-side pinion gear 328 to move the right-side translation cam member 310 rearwards.

When the rearward movement of the translation cam member 310 proceeds, the engagement between the press operating portions 317 of the three rear-side operating members 315 and the pressing lugs 227 of the developer cartridges 27 is released and the pressing on the pressing lugs 227 by the press operating portions 317 is released. Further, as shown in FIG. 19(*b*), the contacting/detaching operation portions 318 of the three rear-side operation members 315 are brought into abutment with the lower end portions of the intermediate members 311 respectively located behind them. As result of this, the lower end portions of the intermediate members 311 are pressed rearwards, so that the intermediate members 311 are pivoted about the intermediate member supporting shafts 321 to be raised up. In the middle of the pivoting of the intermediate members 311, the intermediate members 311 are respectively brought into abutment with the detaching lugs 212 located above the corresponding intermediate members 311 from below, so that upward forces are applied from the intermediate members 311 to the detaching lugs 212. As a result of this, the yellow developer cartridge 27Y, the magenta developer cartridge 27M, and the cyan developer cartridge 27C are lifted up.

Then, when the rearward movement of the translation cam member 310 proceeds further and one end portions of the intermediate members 311 (end portions thereof on the side on which the intermediate member supporting shafts 321 are inserted through the intermediate members 311) are brought into abutment with the upper surfaces of the contacting/detaching operation portions 318 of the three rear-side operation members 315, as shown in FIGS. 19(*c*) and 21, the yellow developer cartridge 27Y, the magenta developer cartridge 27M, and the cyan developer cartridge 27C are placed in the detached position and the developing rollers 39 of the yellow developer cartridge 27Y, the magenta developer cartridge 27M, and the cyan developer cartridge 27C are detached from the respective photosensitive drums 29. At this time, the pressing lugs 227 of the black developer cartridge 27K are pressed by the press operating portions 317 of the operating member 315. As a result of this, only the developing roller 39 of the black developer cartridge 27K is put in the state of being pressed on the photosensitive drum 29.

Thereafter, when the rearward movement of the translation cam member 310 proceeds further, the engagement between the press operating portions 317 of the foremost operating member 315 and the pressing lugs 227 of the black developer cartridge 27K is released and the pressing on the pressing lugs 227 by the press operating portions 317 is released. Further, the contacting/detaching operating portions 318 of the foremost operating member 315 are brought into abutment with the lower end portion of the intermediate member 311 located behind them and the lower end portion of the intermediate member 311 is pressed rearwards, as shown in FIG. 19(*d*). Then, the intermediate member 311 is pivoted about the intermediate member supporting shaft 321 to be raised up. In the middle of the pivoting of the intermediate member 311, the intermediate member 311 is brought into abutment with the detaching lug 212 of the black developer cartridge 27K located above the intermediate member 311 from below, so that an upward force is applied from the intermediate member 311 to the detaching lugs 212. As a result of this, the black developer cartridge 27K is lifted up.

Then, when the rearward movement of the translation cam member 310 proceeds further and one end portion of the intermediate member 311 (an end portion thereof on the side on which the intermediate member supporting shaft 321 is inserted through the intermediate member 311) is brought into abutment with the upper surface of the contacting/detaching operation portion 318 of the foremost operation member 315, as shown in FIGS. 19(*e*) and 22, the black developer cartridge 27K is shifted to the detached position and the developing roller 39 of the black developer cartridge 27K is detached from the photosensitive drum 29. As a result of this, the developing rollers 39 of all the developer cartridges 27 are put in the state of being detached from the respective photosensitive drums 29.

By moving the translation cam members 310 forwards from the state shown in FIG. 19(*e*), the state of FIG. 19(*e*) can be returned to the respective states shown in FIGS. 19(*a*) to 19(*d*). In this case, the protrusions 320 of the contacting/detaching operating portions 318 engage with the intermediate members 311, whereby the intermediate members 311 are pivoted in a direction of moving away from the detaching lugs 212 (downward).

5. Operational Effect

The configuration described above can allow the developer cartridges 27 to shift to the contact positions where the developer rollers 39 contact with the photosensitive drums 29 and the detached positions where the developer rollers 39 detach from the photosensitive drums 29 by the linear movement of the pair of translation cam members 310. Further, this configuration can also allow the developer cartridges 27 to be pressed in a direction in which the developing rollers 39 are put into contact with the photosensitive drums 29 at the contact positions. This can eliminate the need to separately employ members for bringing the developer rollers 39 into contact with and detach from the photosensitive drums 29, members for pressing the developer rollers 39 on the photosensitive drums 29 and the like for each of the developer cartridges 27. As a result of this, reduction in number of components and thus reduction in cost can be achieved, while also reduction in apparatus size can be achieved.

Further, since the pair of translation cam members 310 are linearly moved in synchronization with each other by the synchronous movement mechanism 313 so that asynchronous timing of the linear movement of the translation cam members 310 can be prevented, the developer cartridges 27 can stably be shifted to the contact positions and the detached positions.

Further, the linear movement of the pair of translation cam members 310 can allow the developing rollers 39 of the developer cartridges 27 to selectively switch to the state in which all the developer cartridges 39 of all the developer cartridges 27 are detached from the corresponding photosensitive drums 29 (non-development state), the state in which only the developing roller 39 of the black developer cartridge 27K is pressed on the corresponding photosensitive drum 29 (single color development state), and the state in which all the developing rollers 39 of all the developer cartridges 27 are pressed on the corresponding photosensitive drums 29 (full color development state).

When the developer cartridge 27 is shifted from the contact position to the detached position, the contacting/detaching operating portions 318 of the translation cam members 310 are engaged with the detaching lugs 212 of the developer cartridges 27. On the other hand, when the developer cartridge 27 is pressed, the press operating portions 317 of the translation cam members 310 are engaged with the pressing lugs 227 of the developer cartridge 27.

In a structure in which the developer cartridge 27 is provided with a single engaging portion, so that a force for shifting the developer cartridge 27 from the contact position to the detached position and a force for pressing the developer cartridge 27 at the contact position are input to the engaging portion at the detached position, if the engaging portion does not have a sufficient strength, the operations of contacting, detaching and pressing of the developer cartridge 27 (developing roller 39) may become unstable.

In contrast to this, the structure in which the developer cartridge 27 is provided with the pressing lugs 227 and the detaching lugs 212 can allow a force for contacting/detaching the developer cartridge 27 and a force for pressing the developer cartridge 27 to be input to the developer cartridge 27 in a dispersed manner. Hence, stable operations of contacting, detaching and pressing of the developer cartridge 27 can be achieved, while a simplified structure can be provided for the pressing lugs 227 and the detaching lugs 212 (no reinforcement is required).

Further, in this embodiment, the contacting/detaching operating portions 318 of the translation cam members 310 and the detaching lugs 212 of the developer cartridge 27 can be engaged with each other by the intermediate members 311. Further, a force acting in a moving direction of the translation cam members 310 can be eliminated (cancelled) and only a force acting in a direction in which the developer cartridge 27 is moved can be transmitted to the developer cartridge 27.

By the linear movement of the translation cam members 310, the intermediate member 311 is put in the non-contact state of being detached from the contacting/detaching operating portion 318 of the translation cam members 310, and in this state the intermediate member 311 is detached from the detaching lug 212 of the developer cartridge 27 to allow the developer cartridge 27 to shift to the contact position. Further, by the linear movement of the translation cam members 310, the intermediate member 311 is put in the contact state of being contacted with the contacting/detaching operating portion 318, and in this state the intermediate member 311 contacts with the detaching lug 212 of the developer cartridge 27 to allow the developer cartridge 27 to shift to the detached position. This can ensure that the developer cartridge 27 is reliably shifted to the contact position and the detached position.

When the translation cam members 310 are moved rearwards linearly, the protrusion 320 of the contacting/detaching operating portion 318 is brought into abutment with the intermediate member 311, whereby the intermediate member 311 is pivoted in a direction of moving close to the detaching lugs 212. When the translation cam members 310 are moved forwards linearly, the protrusion 320 of the contacting/detaching operating portion 318 is engaged with the intermediate member 311, whereby the intermediate member 311 is pivoted in a direction of moving away from the detaching lugs 212. This can ensure the pivoting of the intermediate members 311 and further reliable shift of the developer cartridge 27 to the contact position and the detach position.

Further, since the developer cartridge 27 is provided with the handle 214, the developer cartridge 27 can be moved by gripping the handle 214 with hand. This can provide good operability of the developer cartridge 27. In addition, since the pressing lugs 227 are provided on the handle 214, the coiled spring 218 generating a biasing force for pressing the developer cartridge 27 in a direction in which the developing roller 39 contacts with the photosensitive drum 29 can be provided on the developer cartridge 27. This can produce the advantage that whenever the developer cartridge 27 is replaced with a new one, a new coiled spring 218 can be employed thereby to keep on applying a stable biasing force from the new coiled spring to the developer cartridge 27.

In addition, since the pressing lugs 227 and the detaching lugs 212 are provided at both front and rear end portions of the developer cartridge 27 (with respect to the moving direction of the translation cam members 310) to define a wide space therebetween, the engagement between the press operating portions 317 of the translation cam members 310 and the pressing lugs 227 and the engagement between the contacting/detaching operating portions 318 of the translation cam members 310 and the detaching lugs 212 can be switched reliably. This can ensure the reliable shifting of the developer cartridge 27 to the contact position and the detached position as well as the reliable pressing of the developer cartridge 27.

Furthermore, the synchronous movement mechanism 313 can allow the driving force resulting from the linear movement of the left-side translation cam member 310 to be transmitted from the left-side translation cam member 310 to the right-side translation cam member 310, and this can allow the right-side translation cam member 310 to be moved linearly by the transmitted driving force. Thus, the linear movements of the pair of translation cam members 310 can be synchronized reliably.

To be more specific, following the linear movement of the left-side translation cam member 310, the left-side pinion gear 328 is rotated and the right-side pinion gear 330 is rotated by the rotation of the left-side pinion gear 328. Then, the rotation of the right-side pinion gear 330 is transmitted to the right-side rack gear 329, so that the right-side rack gear 329 and the right-side translation cam member 310 are both moved linearly. Thus, the pair of translation cam members 310 can be moved linearly in further reliable synchronization with each other.

In this color laser printer 1, the drum unit 26 can be detachably mounted to the main body casing 2. Due to this, the maintenance work, such as treatment of paper jam and component replacement, can be facilitated.

Further, since each of the developer cartridges 27 can be replaced separately, maintenance costs can be reduced.

Further, since the direction of the linear movement of the translation cam members 310 and the direction of the mounting and dismounting of the drum unit 26 are the same, the manual operation for the linear movement of the translation cam members 310 and the mounting and dismounting operation of the drum unit 26 can be done from the same direction. This can allow both the manual operation for linear movement of the translation cam members 310 and the mounting and dismounting operation of the drum unit 26 via the mounting port 8 formed in the main body casing 2.

When the translation cam members 310 are moved toward the front wall 203 on which the supported projections 228 of the developer cartridge 27 are provided, the developer cartridge 27 is pressed and, by use of the pressing force, the supported projections 228 are pressed against the supporting rollers 110. Hence, the stable support of the developer cartridge 27 by the supporting rollers 110 can be achieved.

The paper 3 is carried by the carrying belt 58, during which toner images respectively carried on the photosensitive drums 29 are transferred directly to the paper 3 and recorded on it. Therefore, as compared with the intermediate transfer type apparatus, the number of components can be reduced since the intermediate transfer belts can be eliminated.

While the illustrative embodiments of the present invention are provided in the above description, such is for illustrative purpose only and it is not intended to limit the present invention precisely along the contents disclosed. Modification and variation of the present invention could be made in the light of the description above and could be obtained by carrying out the invention. The illustrated embodiments are selected for explaining the essence of the present invention and the practically applicable plans that will enable those skilled in the art to make a use of the present invention for various embodiments and to make various modifications suitable for expected specific uses. The scope of the present invention should be limited by the accompanying claims and equivalents thereof.

What is claimed is:

1. An image forming apparatus comprising:

an apparatus body including an accommodating portion;

a holder configured to hold a plurality of drum units and a plurality of developing units, wherein the plurality of drum units and the plurality of developing units are arranged in a first direction, wherein each of the plurality of drum units includes an image carrier, wherein each of the plurality of developing units includes a developing agent carrier, and wherein the holder is configured to move along the first direction with respect to the accommodating portion;

a translation cam configured to move along the first direction, wherein the translation cam is configured to allow at least one of the plurality of developing units to shift to:

contact positions where the developing agent carrier contacts the image carrier, and detached positions where the developing agent carrier detaches from the image carrier; and a cam holder having a plurality of cut away portions configured to allow the translation cam to engage with the developing units.

2. The image forming apparatus according to claim 1, wherein the cam holder is configured to hold the translation cam.

3. The image forming apparatus according to claim 1, wherein a linear movement of the translation cam is configured to allow the developing units to selectively switch to:

a non-development state where all the developing units are shifted to the detached positions, a single color development state where only one developing unit is shifted to the contact positions, and a full color development state where all the developing units are shifted to the contact positions.

4. The image forming apparatus according to claim 1, further comprising a belt arranged opposite to the plurality of image carriers.

5. The image forming apparatus according to claim 1, wherein the translation cam comprises a pair of translation cam members disposed opposite to each other across the plurality of developing units, and the image forming apparatus includes a synchronous movement mechanism configured to allow the pair of translation cam members to linearly move in synchronization.

6. The image forming apparatus according to claim 1, wherein the translation cam includes a plurality of pressing portions configured to press the developing units, and a plurality of contacting/detaching operating portions configured to allow the developing units to selectively shift to the contact positions and the detached positions, and the developing units each include first engaging portions configured to engage with the pressing portions, and second engaging portions configured to engage with the contacting/detaching operating portions.

7. The image forming apparatus according to claim 6,

Wherein the cut away portions include a plurality of first receiving portions formed to be receivable with the first engaging portions and a plurality of second receiving portions formed to be receivable with the second engaging portions.

8. The image forming apparatus according to claim 6, further comprising intermediate members configured to allow the contacting/detaching operating portions and the second engaging portions to engage with each other.

9. The image forming apparatus according to claim 8, wherein the intermediate members are each pivotable about a pivot shaft axis extending in a direction orthogonal to a moving direction of the translation cam, so that the intermediate members are pivotable to:

non-contact states of detaching from the contacting/detaching operating portions, and contact states of contacting the contacting/detaching operating portions by a linear movement of the translation cam, then detaching from the second engaging portions in the non-contact states to allow the developing units to shift to the contact positions and subsequently being brought into contact with the second engaging portions in the contact states to allow the developing units to shift to the detached positions.

10. The image forming apparatus according to claim 9, wherein the contacting/detaching operating portions include operating portions configured to be brought into abutment with the intermediate members to pivot the intermediate members from the non-contact states to the contact states when the translation cam is moved linearly in one direction and are brought into engagement with the intermediate members to pivot the intermediate members from the contact state to the non-contact states when the translation cam is moved linearly in another direction opposite to the one direction.

11. The image forming apparatus according to claim 6, wherein one of the contacting/detaching operating portions is formed to be shorter in length in a moving direction of the translation cam than the other contacting/detaching operating portions.

12. The image forming apparatus according to claim 6, wherein the developing units include handles to be gripped when the developing units are moved, and the first engaging portions are provided on the handles.

* * * * *